US008877419B2

(12) United States Patent
Inoue et al.

(10) Patent No.: US 8,877,419 B2
(45) Date of Patent: Nov. 4, 2014

(54) METHOD OF FORMING COMPOSITE COLOR IMAGE

(75) Inventors: Satoshi Inoue, Kanagawa (JP); Koutarou Yoshihara, Kanagawa (JP); Yosuke Tsurumi, Kanagawa (JP); Moegi Iguchi, Kanagawa (JP); Masahiro Takagi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1532 days.

(21) Appl. No.: 11/504,685

(22) Filed: Aug. 16, 2006

(65) Prior Publication Data

US 2007/0172748 A1 Jul. 26, 2007

(30) Foreign Application Priority Data

Jan. 25, 2006 (JP) ..... 2006-016363

(51) Int. Cl.

*G03G 13/14* (2006.01)
*G03G 9/113* (2006.01)
*G03G 15/01* (2006.01)

(52) U.S. Cl.

CPC .... *G03G 15/0126* (2013.01); *G03G 2215/0119* (2013.01); *G03G 2215/0158* (2013.01)
USPC ..... 430/125.32; 430/111.35; 430/111.4; 430/124.32; 399/162; 399/231; 399/302

(58) Field of Classification Search

USPC ..... 430/45.56, 47.2, 47.4, 111.35, 111.4, 430/124.32, 125.32; 399/162, 231, 302
See application file for complete search history.

(56) References Cited

U.S. PATENT DOCUMENTS

| | | | | |
|---|---|---|---|---|
| 5,573,880 | A * | 11/1996 | Mayama et al. | 430/111.3 |
| 5,778,291 | A * | 7/1998 | Okubo et al. | 399/302 |
| 6,013,406 | A * | 1/2000 | Moriki et al. | 430/108.22 |
| 2003/0035664 | A1* | 2/2003 | Takahata et al. | 399/302 |
| 2004/0208678 | A1* | 10/2004 | Yoda et al. | 399/302 |
| 2005/0170274 | A1 | 8/2005 | Matsumura et al. | |
| 2005/0175923 | A1* | 8/2005 | Nakazawa et al. | 430/110.3 |
| 2005/0214671 | A1* | 9/2005 | Mizutani et al. | 430/111.35 |
| 2006/0045578 | A1* | 3/2006 | Ichizawa | 399/302 |

FOREIGN PATENT DOCUMENTS

| | | |
|---|---|---|
| JP | A 59-24416 | 2/1984 |
| JP | B 59-24416 | 6/1984 |
| JP | A 2-135371 | 5/1990 |
| JP | A 5-100493 | 4/1993 |
| JP | A 7-271106 | 10/1995 |
| JP | A 8-3679 | 1/1996 |
| JP | B 8-3679 | 1/1996 |
| JP | A 2004-61730 | 2/2004 |
| JP | A 2004-77568 | 3/2004 |
| JP | A 2005-181657 | 7/2005 |
| JP | A-2005-215268 | 8/2005 |
| JP | A 2005-215397 | 8/2005 |
| KR | A-2003-0095498 | 12/2003 |

OTHER PUBLICATIONS

Jan. 25, 2011 Japanese Office Action issued in Japanese Patent Application No. 2006-016363 (with translation).

* cited by examiner

*Primary Examiner* — Jonathan Jelsma
(74) *Attorney, Agent, or Firm* — Oliff PLC

(57) ABSTRACT

The present invention provides a composite color image forming method. The method includes electrically charging a latent image-holding member; exposing the charged latent image-holding member to light to form an electrostatic latent image; developing the electrostatic latent image with a two-component developer containing toner particles of one color and a carrier to form a toner image on the latent image-holding member; primarily transferring the toner image from the latent image-holding member to an intermediate transfer member; repeating the electrically charging, the exposing, the developing, and the primarily transferring, while the toner particles are replaced with toner particles of different color, to form a composite color image on the intermediate transfer member; and secondarily transferring the composite color image from the intermediate transfer member to a recording medium. The carrier contains magnetic substance-dispersed core particles in which a magnetic substance is dispersed in a resin, and a coating layer that coats the surface of each of the magnetic substance-dispersed core particles at a covering rate of 95% or more. In addition, the carrier has a degree of circularity of 0.970 or more. The intermediate transfer member is a belt that has a substrate whose Young's modulus is in the range of 3,000 to 6,500 MPa. During the primary transferring, primary transfer nip pressure is in the range of 8 to 20 gf/cm, and a value (T/P) obtained by dividing a primary transfer current value T (μA) by a processing speed P (mm/sec) is from 0.08 to 0.18.

12 Claims, 3 Drawing Sheets

METHOD OF FORMING COMPOSITE COLOR IMAGE

BACKGROUND

1. Technical Field

The invention relates to a method of forming a composite color image, and more particularly, to a method of forming a composite color image, in which image quality is improved by preventing transfer misalignment and deterioration in transfer properties, and carrier pieces are prevented from sticking into the surface portion of a photoreceptor.

2. Related Art

A method for visualizing image information through electrostatic latent images by electrophotography is presently employed in various fields. In electrophotography, an image is obtained by forming an electrostatic latent image on a photoreceptor (i.e., a latent image-holding member) in charging and exposing steps; developing the electrostatic latent image with a developer including a toner to obtain a toner image; transferring the toner image to the surface of a recording medium; and fixing the toner image on the recording medium. Developers used in the development are classified into two groups: two-component developers each including a carrier and a toner, and single-component developers including a toner only, such as a magnetic toner.

Since the functions of a developer are allocated to the carrier and the toner in the two-component developers, specifically, the functions of agitating, conveying, and charging are allocated to the carrier, the two-component developers have excellent controllability, and are widely used. Among them, developers that include carrier particles each having a resin coating have excellent controllability of charging, and dependence thereof on the environment and stability thereof over time can be relatively easily improved.

The two-component developers are advantageous in, particularly, reproducing color photo images, because highly precise control of charging can be performed.

In order to further improve image quality, various techniques for the two-component developers have been suggested.

Use of these techniques can improve image quality. However, as processing speed increases, image defects and cleaning failure that are thought to be caused by the carrier occur even in such techniques.

SUMMARY

In recent years, color images are starting to be as widely used as monochrome images, and output speeds of color images increases and processing speeds (conveying speeds) also increase every year. Therefore, in order to maintain the transfer properties in primary transfer even in high-speed processing, techniques have been adopted in which the transfer current value is increased or nip pressure is raised.

In such circumstances, as a result of closely studying the above-described problems of image defects and cleaning failure that are thought to be caused by the carrier which problems occur as processing speeds (conveying speeds) are increased, the reason for this is supposedly as follows. A part of the carrier particles adhering to the photoreceptor at the time of primary transfer break. The resultant carrier pieces (broken fine particles) stick into the surface portion of the photoreceptor at the primary transfer nip. As the amount of the carrier pieces sticking into the photoreceptor increases, quality of images transferred degrades, and the cleaning blade is damaged, which results in occurrence of cleaning failure.

In order to prevent carrier pieces from sticking into the photoreceptor, the coating layer of the carrier may be thickened or the adhesion between the coating layer and the core may be increased. These prevent the core from entirely or partially remaining bare and prevent carrier pieces from scattering. These can be attained by techniques of the related art.

Thus, prevention of carrier pieces from sticking into the photoreceptor has not been possible by the techniques up until now, in which the core or the coating layer is simply changed to prevent the carrier pieces from scattering.

Further, the occurrence of transfer misalignment and or deterioration in transfer properties caused by increasing processing speeds cannot be resolved by varying the carrier only.

Accordingly, conditions of primary transfer in which image quality is excellent even at high processing speeds, and conditions of primary transfer in which carrier pieces stick into a photoreceptor have been located. As a result of researching carriers that do not easily crush under these conditions, it has been figured out that specific image formation enables suppression of sticking, damage of a cleaning blade and prevention of cleaning failure.

According to an aspect, there is provided a method of forming a composite color image, including: electrically charging a latent image-holding member; exposing the charged latent image-holding member to light to form an electrostatic latent image; developing the electrostatic latent image with a two-component developer containing toner particles of one color and a carrier to form a toner image on the latent image-holding member; primarily transferring the toner image from the latent image-holding member to an intermediate transfer member; repeating the electrically charging, the exposing, the developing, and the primarily transferring, while the toner particles are replaced with toner particles of different color, to form a composite color image on the intermediate transfer member; and secondarily transferring the composite color image from the intermediate transfer member to a recording medium; the carrier including magnetic substance-dispersed core particles in which a magnetic substance is dispersed in a resin, and a coating layer that is made of a resin and that coats the surface of each of the magnetic substance-dispersed core particles at a covering rate of about 95% or more, the carrier having a degree of circularity of about 0.970 or more, the intermediate transfer member being a belt that has a substrate whose Young's modulus is in the range of about 3,000 to about 6,500 MPa, and during the primary transferring, primary transfer nip pressure being in the range of about 8 to about 20 gf/cm, and a value (T/P) obtained by dividing a primary transfer current value T by a processing speed P being in the range of about 0.08 to about 0.18 μA.sec/mm.

In order to provide maintainability of a contact-type intermediate transfer member and suppress transfer misalignment of each color, it is preferably to use a substrate having a large Young's modulus (about 3000 MPa or more). However, it has been found that such a substrate is disadvantageous in respect to prevention of sticking of carrier pieces. To get the best out of using such an intermediate transfer member, it is necessary to control key parameters of a primary transfer nip portion as follows.

In this aspect, it is necessary that the nip pressure of the primary transfer be set in the range of about 8 to about 20 gf/cm. If the nip pressure of the primary transfer is greater than bout 20 gf/cm, the carrier easily cracks in the transfer nip portion, and the carrier pieces generated stick into the photoreceptor. Meanwhile, the nip pressure of the primary transfer being lower than about 8 gf/cm leads to lowered primary transfer efficiency.

Further, in order to maintain the transfer properties in primary transfer even at high processing speeds, the value of the transfer current needs to be increased. In this aspect, the value (T/P) obtained by dividing a primary transfer current value T (μA) by a processing speed P (mm/sec) is in the range of about 0.08 to about 0.18. If the primary transfer current value T (μA) is higher than the necessary, carrier particles that have a small degree of circularity (carrier particles each having a big difference between the longest length and the shortest length) stand up at the transfer nip portion, and the acute angled portion of each of the carrier particles easily comes into contact with the photoreceptor. As a result, the carrier particles easily stick into the photoreceptor. Accordingly, if the T/P is greater than about 0.18, excessive current flows in the primary transfer member, and the carrier particles easily stick into the photoreceptor. Meanwhile, the T/P being less than about 0.08 results in degraded primary transfer properties, and lowered transfer efficiency and image quality.

In order to suppress generation and scattering of carrier pieces under such conditions for image formation, it is necessary that a resin covers the surfaces of the magnetic substance-dispersed particles serving as cores at a covering rate of at least 95% and that the degree of circularity of the carrier be about 0.970 or more.

Thus, according to this aspect, transfer misalignment and deterioration in the transfer properties are prevented, improving image quality. Moreover, prevention of carrier pieces from sticking into the photoreceptor reduces image quality defects. Further, since damage of a cleaning blade that comes into contact with the photoreceptor can also be suppressed, good cleaning properties can be achieved, and thus the life span of the cleaning blade can be lengthened.

BRIEF DESCRIPTION OF THE DRAWINGS

Exemplary embodiments of the invention will be described in detail based on the following figures, wherein.

DETAILED DESCRIPTION

Carrier

Figure 1:
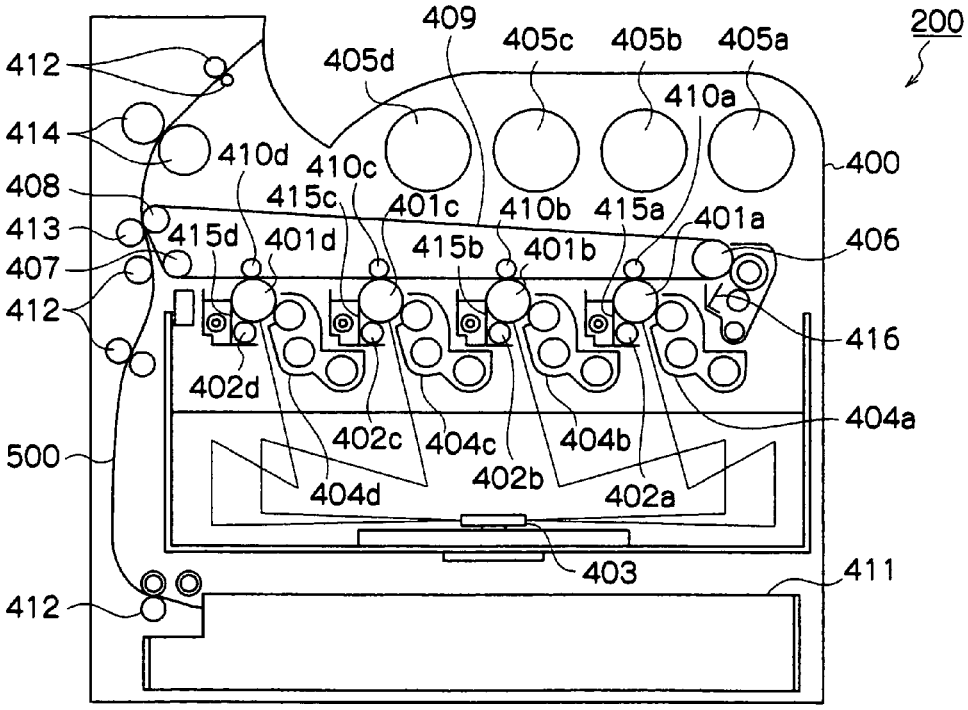
FIG. 1 is a diagram schematically illustrating the structure of an exemplary embodiment of an image forming apparatus used in the invention.

Hereinafter, carrier particles (a carrier) each having, as a core, a magnetic substance (powder)-dispersed particle in which magnetic powder is dispersed in a resin, and carrier particles (a carrier) each having, as a core, a magnetic substance such as iron powder or ferrite will be explained. The former carrier is used in the first aspect and the latter carrier is used in the second aspect.

(1) Carrier in First Aspect (Carrier whose Core is a Magnetic Substance-Dispersed Particle)

Each of the carrier particles in the first aspect has, as a core, a magnetic powder-dispersed particle in which magnetic powder is dispersed in a resin. Each of the carrier particles in the first aspect has a coating layer that is made of a resin and that coats the surface of the magnetic powder-dispersed particle. The covering rate of the coating layer of the carrier is about 95% or more. Moreover, the carrier has a degree of circularity of about 0.970 or more.

1) Core

Examples of the magnetic substance that is dispersed in the core include magnetic metals such as iron, copper, nickel, and cobalt; alloys including at least one of these magnetic metals and at least one of manganese, chromium and rare earth elements, such as an alloy of nickel and iron, an alloy of cobalt and iron, and an alloy of aluminum and iron; and magnetic oxides such as ferrite and magnetite. Among them, the magnetic substance is preferably iron oxide. The magnetic powder that is made of iron oxide has stable characteristics and weak toxicity.

One kind selected from these magnetic substances may be used, or two or more kinds of these magnetic substances may be used together.

The average diameter of the magnetic powder (substance) to be dispersed is preferably in the range of about 0.01 to about 1 μm, more preferably in the range of about 0.03 to 0.5 μm, and still more preferably in the range of about 0.05 to 0.35 μm. When the average diameter is less than about 0.01 μm, cores each including such magnetic powder may have decreased saturation magnetization, and a composition (mixture of raw materials including at least one monomer and such magnetic powder) for forming a core may have an increased viscosity, and therefore core particles having a uniform diameter may not be obtained. Meanwhile, when the average diameter exceeds about 1 μm, homogeneous magnetic powder (particles) may not be obtained.

The content of the magnetic substance(s) contained in the magnetic powder-dispersed particles is preferably in the range of about 30 to about 99 percent by mass, more preferably in the range of about 45 to about 97 percent by mass, and still more preferably in the range of about 60 to about 95 percent by mass. When the content is less than about 30 percent by mass, the magnetic substance-dispersed carrier may scatter in an image forming apparatus. When the content is greater than about 99 percent by mass, a magnetic brush formed by the magnetic substance-dispersed carrier may be hard, and easily crack.

Examples of the resin (matrix) contained in the magnetic powder-dispersed particles include cross-linked styrene resin, acrylic resin, styrene-acrylic copolymer resin, and phenol resin.

The magnetic powder-dispersed particles used in the invention may contain other component(s) as well as the matrix and the magnetic powder, according to the intended purpose thereof. Examples of other components include a charge control agent and fluorine-containing particles.

The volume average particle diameter of the cores contained in the carrier particles used in the first aspect is preferably in the range of about 10 to about 500 μm, more preferably in the range of about 30 to about 150 μm, and still more preferably in the range of about 30 to about 100 μm. When the volume average particle diameter is less than about 10 μm, such a carrier is likely to adhere to a photoreceptor, and has decreased productivity. When the volume average particle diameter is greater than about 500 μm, images obtained by using a developer including such a carrier may have an unnecessary stripe pattern, which is called a brush mark, and a rough surface.

The volume average particle diameter corresponds to a diameter that is obtained with a laser diffraction/diffusion particle diameter measuring device (LS PARTICLE SIZE ANALYZER LS13 320 manufactured by BECKMAN COULTER Company). When the whole particle size range of a particle size distribution obtained by using the device is divided into several size ranges (channels) and a volume cumulative distribution curve is drawn from the smallest range, the particle diameter at a cumulant of 50% is regarded as the volume average particle diameter ($D_{50V}$).

A method for producing the magnetic powder-dispersed particles may be a melting kneading method in which magnetic powder and a binder resin such as styrene-acrylic resin are melted and kneaded by a BANBURY mixer or a kneader, and the resultant mixture is cooled down and pulverized, and the resultant particles are classified (see Japanese Patent Application Publication (JP-B) Nos. S59-24416 and H08-3679); a suspension polymerization method in which at least one monomer of a binder resin and magnetic powder are dispersed in a solvent and the at least one monomer is polymerized in the resultant suspension (see, for example, JP-A No. 5-100493); or a spray drying method in which a dispersion liquid obtained by dispersing magnetic powder in a resin solution is sprayed and dried.

All of the melting kneading method, the suspension polymerization method, and the spray drying method include preparing magnetic powder by some method and dispersing the magnetic powder in a resin solution.

2) Coating Layer

Each of the carrier particles used in the first aspect has a core and a coating layer on the surface of the core. The coating layer is preferably a resin coating layer made of a matrix resin.

The covering rate at which the coating layer coats the surfaces of the cores is about 95% or more, and preferably about 97% or more. If the covering rate is less than about 95%, bare portions of the core, which easily cause crack of the core, are large, and therefore it is impossible to sufficiently suppress breakage of a carrier including such a core.

In the invention, the covering rate of the cores is obtained by measuring the area of at least one peak derived from an element of a magnetic substance existing on the surfaces of the cores (uncovered) and the area of at least one peak derived from the element existing on the surfaces of the carrier particles (covered) with an XPS device, and assigning the measured areas to the following equation.

Covering rate (%)={1−(peak area resulting from magnetic substance (e.g., iron) existing on surfaces of carrier particles)/(peak area resulting from magnetic substance existing on surfaces of cores)}×100

The average thickness of the coating layer is preferably about 0.1 to about 10 μm, more preferably about 0.1 to about 3.0 μm, and most preferably about 0.1 to about 1.0 μm. If the average thickness of the coating layer is smaller than about 0.1 μm, long-term use of such a carrier may cause the coating layer to undesirably peel off and, therefore, may cause the resistance of the carrier to lower, or it may be difficult to sufficiently suppress breakage of the carrier. Meanwhile, if the average thickness is greater than about 10 μm, it takes a long time for such a core to electrically charge a toner to a saturation charge amount.

The matrix resin may be an ordinary one. Examples thereof include polyolefin resin such as polyethylene and polypropylene; polyvinyl and polyvinylidene resins such as polystyrene, acrylic resin, polyacrylonitrile, polyvinyl acetate, polyvinyl alcohol, polyvinyl butyral, polyvinyl chloride, polyvinyl carbazole, polyvinyl ether, and polyvinyl ketone; vinyl chloride-vinyl acetate copolymer; styrene-acrylic acid copolymer; straight silicone resin containing organosiloxane bonds and modified products thereof; fluorinated resin such as polytetrafluoroethylene, polyvinyl fluoride, polyvinylidene fluoride, and polychlorotrifluoroethylene; polyester; polyurethane; polycarbonate; phenol resin; amino resin such as urea-formaldehyde resin, melamine resin, benzoguanamine resin, urea resin, and polyamide resin; silicone resin; and epoxy resin.

One of these may be used alone, or two or more of them may be used together.

To prevent toner components from contaminating the carrier, it is preferable to use a resin with low surface energy such as fluorinated resin or silicone resin as the coating resin. It is more preferable to use fluorinated resin for coating.

Examples of the fluorinated resin include fluorinated polyolefin; fluoroalkyl(meth)acrylate homopolymer and copolymer; vinylidene fluoride homopolymer and copolymer; and mixtures thereof. Typical examples of a fluorinated monomer that is contained in the raw material(s) of the fluorinated resin include, but are not limited to, fluoroalkyl methacrylate monomers such as tetrafluoropropyl methacrylate, pentafluoropropyl methacrylate, octafluoropentyl methacrylate, perfluorooctylethyl methacrylate, and trifluoroethyl methacrylate.

The content of the at least one fluorinated monomer in all the monomers of a coating resin is preferably in the range of about 0.1 to about 50.0 percent by mass, more preferably in the range of about 0.5 to about 40.0 percent by mass, and most preferably in the range of about 1.0 to about 30 percent by mass. When the content is less than about 0.1 percent by mass, it is difficult to ensure contamination resistance of the carrier. When the content exceeds about 50.0 percent by mass, such a carrier has lowered adhesion of the coating resin to the core, and a decreased charging property.

The coating layer may contain resin particles dispersed therein.

The resin particles may be, for example, thermoplastic resin particles or thermosetting resin particles. Among them, the resin particles are preferably thermosetting resin particles, whose hardness is relatively easy to increase. Alternatively, the resin particles are also preferably nitrogen atom-containing resin particles to negatively charge a toner. Particles of one kind of these resins may be used, or those of two or more kinds of them may be used together.

It is preferable that the resin particles are dispersed in the matrix resin as evenly both in a direction parallel to the thickness of the resin coating layer and in a direction parallel to the tangential line with respect to the carrier surface as possible. The resin of the resin particles and the matrix resin having high compatibility improves evenness in dispersion of the resin particles in the coating resin layer.

Examples of the resin of the thermoplastic resin particles include polyolefin resin such as polyethylene and polypropylene; polyvinyl and polyvinylidene resins such as polystyrene, acrylic resin, polyacrylonitrile, polyvinyl acetate, polyvinyl alcohol, polyvinyl butyral, polyvinyl chloride, polyvinyl carbazole, polyvinyl ether, and polyvinyl ketone; vinyl chloride-vinyl acetate copolymer; styrene-acrylic acid copolymer; straight silicone resin containing organosiloxane bonds and modified products thereof; fluorinated resin such as polytetrafluoroethylene, polyvinyl fluoride, polyvinylidene fluoride, and polychlorotrifluoroethylene; polyester; polyurethane; and polycarbonate.

Examples of the resin of the thermosetting resin particles include phenol resin; amino resin such as urea-formaldehyde resin, melamine resin, benzoguanamine resin, urea resin, and polyamide resin; silicone resin; and epoxy resin.

The resin of the resin particles may be the same as or different from the matrix resin. It is preferable that the resin of the resin particles is different from the matrix resin.

If thermosetting resin particles are used as the resin particles, a carrier including such resin particles may have improved mechanical strength. In particular, the resin of the resin particles preferably has a cross-linking structure. Further, to improve the function of the resin particles whereby the resin particles serve as electric charging sites, it is preferable that the resin of the resin particles can quickly charge a toner. The particles of such a resin are preferably those of a nitrogen-containing resin such as nylon resin, amino resin, or melamine resin.

The resin particles can be produced by a method in which granulated resin particles are produced by polymerization such as emulsion polymerization or suspension polymerization, a method in which resin particles are produced by cross-linking at least one monomer and/or at least one oligomer dispersed in a solvent to granulate the product; or a method in which resin particles are produced by mixing and reacting at least one low molecular weight component and at least one cross-linking agent by melting and kneading, and by pulverizing the product to a predetermined particle size with air blow or mechanical force.

The volume average diameter of the resin particles is preferably in the range of about 0.1 to about 2.0 μm, and more preferably about 0.2 to about 1.0 μm. When the volume average diameter of the resin particles is smaller than about 0.1 μm, such resin particles may have deteriorated dispersibility in the resin coating layer. Meanwhile, when the volume average diameter of the resin particles is larger than about 2.0 μm, such resin particles may easily drop off the resin coating layer, and thus a carrier including the resin particles may not have stable charging properties. A method for measuring the volume average diameter of resin particles is the same as the method for measuring the volume average diameter of cores.

The content of the resin particles in the coating layer is preferably about 1 to about 50% by volume, more preferably about 1 to about 30% by volume, and even more preferably about 1 to about 20% by volume. When the content of the resin particles in the coating layer is less than about 1% by volume, the effect of the resin particles may not show. Meanwhile, when the content exceeds about 50% by volume, the resin particles may easily drop off the coating resin layer, and thus a carrier including the resin particles may not have stable charging properties.

The coating layer may also contain at least one electrically conductive powder dispersed therein.

Examples of the material of the electrically conductive powder include metals such as gold, silver, and copper; carbon black; metal oxides such as titanium oxide, magnesium oxide, zinc oxide, and aluminum oxide; calcium carbonate; aluminum borate; potassium titanate, and calcium titanate; and powders in which titanium oxide, zinc oxide, barium sulfate, aluminum borate, and potassium titanate powder are coated with at least one of tin oxide, carbon black and a metal. One kind of these may be used alone, or two or more kinds of them may be used together. When metal oxide powder is used as the electrically conductive powder, the degree of dependency of charging properties of the carrier on the environment can be lowered. The electrically conductive powder is particularly preferably titanium oxide powder.

The powders of those materials are preferably treated with at least one coupling agent. In particular, the electrically conductive powder is preferably metal oxide powder treated with at least one coupling agent, and more preferably titanium oxide powder treated with at least one coupling agent. The electrically conductive powder treated with at least one coupling agent can be obtained by dispersing untreated electrically conductive powder in a solvent such as toluene, mixing and treating the powder dispersed with at least one coupling agent, and then drying the powder at a reduced pressure.

Further, the electrically conductive powder treated with at least one coupling agent may be pulverized by a pulverizer to crush agglomerates, if necessary. Examples of the pulverizer include those conventionally known such as a pin mill, a disk mill, a hummer mill, a centrifugation-type mill, a roller mill, and a jet mill. The pulverizer is preferably a jet mill. Each of the at least one coupling agent may be a conventionally known one such as a silane coupling agent, a titanium coupling agent, an aluminum coupling agent, or a zirconium coupling agent.

The electrically conductive powder treated with a silane coupling agent, particularly methyltrimethoxysilane, is effective for environmental stability of charging property of the carrier.

The volume average particle diameter of the electrically conductive powder is preferably about 0.5 μm or smaller, more preferably about 0.05 to about 0.45 μm, and even more preferably about 0.05 to about 0.35 μm. A method for measuring the volume average particle diameter of the electrically conductive powder is based on the above-described method for measuring the volume average particle diameter of cores.

When the volume average particle diameter of the electrically conductive powder exceeds about 0.5 μm, the powder easily drops off the coating resin layer, and thus a carrier including such an electrically conductive powder may not have stable charging properties.

The volume electric resistance of the electrically conductive powder is preferably about $10^1$ Ω.cm to about $10^{11}$ Ω.cm, and more preferably about $10^3$ Ω.cm to about $10^9$ Ω.cm. In this specification, the volume electric resistance of the electrically conductive powder is measured by the following method.

An electrically conductive powder is packed in a container having a cross-sectional area of $2\times10^{-4}$ $m^2$ at an ordinary temperature at an ordinary humidity to form a layer of the powder having a thickness of about 1 mm. A load of $1\times10^4$ $Kg/m^2$ is applied to the layer with a metallic member. A voltage necessary to generate an electric field of $10^6$ V/m is applied between the metallic member and an electrode on the bottom surface of the container. A current value running at this time is measured, and a value calculated from the current and the applied voltage is defined as the volume electric resistance of the electrically conductive powder packed.

The content of the electrically conductive powder in the coating resin layer is generally about 1 to about 80% by volume, preferably about 2 to about 20% by volume, and more preferably about 3 to about 10% by volume.

A method for forming a coating layer on the surfaces of the cores of carrier particles may be an immersion method in which carrier cores are immersed in a solution for forming a coating layer, a spray method in which carrier cores are sprayed with a solution for forming a coating layer, a fluidized bed method in which carrier cores that are being fluidized with a fluidization air are sprayed with a solution for forming a coating layer, or a kneader coater method in which a solution for forming a coating layer is mixed with carrier cores and the solvent is removed in a kneader coater. In these methods, the solution for forming a coating layer contains the aforementioned resin(s), the magnetic powder(s), and at least one solvent and, if necessary, the aforementioned electrically conductive material and/or the resin particles.

The solvent(s) of the solution for forming a coating layer needs to dissolve the resin(s) therein, but otherwise there is no limit thereto. Examples thereof include aromatic hydrocarbons such as toluene and xylene; ketones such as acetone and methyl ethyl ketone; and ethers such as tetrahydrofuran and dioxane.

Further, to form a coating layer at a covering rate within the above-described range, a fluidized bed device is preferably used in which core particles that are being dispersed and fluidized in an air flow are sprayed with a coating solution for forming a coating layer.

3) Physical Properties of Carrier

The degree of circularity of the carrier used in the first aspect is preferably about 0.970 or more, and more preferably about 0.974 or more. If the degree of circularity is less than about 0.970, the distorted portions of such a carrier easily cause the carrier to break.

The degree of circularity of the carrier is obtained as follows. First, 0.03 grams of carrier particles are dispersed in an aqueous solution containing 25 mass % of ethylene glycol, and the resultant dispersion is put in an analyzer, FPIA3000 (manufactured by Sysmex Corporation). Carrier particles having diameters out of the range of 10 to 50 μm are excluded from analysis, and the images of the other carrier particles are taken in an LPF measuring mode and analyzed to obtain the degree of circularity of the carrier.

To manufacture magnetic powder-dispersed core particles having a degree of circularity within the aforementioned range in a melting kneading method, the pulverized particles are preferably subjected to hot air treatment to make the particles spherical.

To manufacture magnetic powder-dispersed core particles having a degree of circularity within the range in a polymerization method, phenol and aldehyde may be preferably polymerized.

To achieve a degree of circularity within the range, the coating layer is preferably formed with a fluidized bed device, in which core particles that are being dispersed and fluidized in an air flow, are sprayed with a coating solution for forming a coating layer.

The saturation magnetization of the carrier used in the first aspect is preferably about 40 emu/g or higher, and more preferably about 50 emu/g or higher.

For measurement of the magnetic characteristics of the carrier, a sample-vibrating-type magnetism measurement apparatus VSMP 10-15 (manufactured by Toei Kogyo Co.) is used. A measurement sample is packed in a cell having an inner diameter of 7 mm and a height of 5 mm, and the cell is put in the apparatus. The measurement is carried out by applying a magnetic field to the sample and conducting sweeping up to 1,000 Oe. Next, the applied magnetic field is weakened and a hysteresis curve is drawn on recording paper. Saturation magnetization, residual magnetization, and coercive force are obtained from the data of the drawn curve. In the invention, the saturation magnetization is magnetization measured under a magnetic field of 1,000 Oe.

The volume electric resistance of the carrier used in the first aspect is preferably controlled within the range of about $1\times10^{7}$ to about $1\times10^{15}$ Ω.cm, more preferably within the range of about $1\times10^{8}$ to about $1\times10^{14}$ Ω.cm, and most preferably within the range of about $1\times10^{8}$ to about $1\times10^{13}$ Ω.cm.

When the volume electric resistance of the carrier used in the first aspect is greater than about $1\times10^{15}$ Ω.cm, such a carrier has high resistance and is unlikely to serve as a development electrode at the time of development. As a result, an edge effect may show at solid image portions, resulting in deteriorated solid reproducibility. Meanwhile, when the volume electric resistance of the carrier used in the first aspect is less than about $1\times10^{7}$ Ω.cm, such a carrier has low resistance. As a result, when the concentration of a toner in a developer has become lower than the necessary, electric charge may undesirably migrate from a development roller to the carrier, which may adhere to a latent image.

The volume electric resistance (Ω.cm) of the carrier is measured as follows. The measurement environment is controlled so that temperature is 20° C. and so that humidity is 50% RH.

A carrier (carrier particles), which is a measurement object, is flatly placed on the surface of a circular jig having an electrode plate with an area of 20 $cm^2$ to form a carrier layer having a thickness of about 1 to about 3 mm. Another electrode plate having an area of 20 $cm^2$ is placed on the carrier layer so that the two electrode plates sandwich the carrier layer. A load of 4 kg is applied to the electrode plate placed on the carrier layer to eliminate voids among the carrier particles, and the thickness (cm) of the carrier layer is then measured. Both of the electrode plate on the carrier layer and that under the carrier layer are electrically connected to an electrometer and a high voltage electric power generation apparatus. A high voltage is applied to both the electrode plates so as to generate an electric field of $10^{3.8}$ V/cm and the electric current value (A) running at this time is measured. The volume electric resistance (Ω.cm) of the carrier is calculated by assigning these data to the following equation (1).

$$R=E\times20/(I-I_0)/L \qquad \text{Equation (1)}$$

In Equation (1), R indicates the volume electric resistance (Ω.cm) of the carrier, E indicates the applied voltage (V), I indicates the measured current value (A), $I_0$ indicates the current value (A) at an applied voltage of 0 V, and L indicates the thickness of the carrier layer (cm). Further, a coefficient of 20 indicates the area ($cm^2$) of the electrode plates.

(2) Carrier in Second Aspect (Carrier Particles each having, as a Core, a Magnetic Substance Particle)

Each of the carrier particles used in the second aspect has, as a core, a magnetic substance particle. The magnetic substance particle has surface roughness Sm (mean spacing (interval) between protrusions) of about 2.0 μm or less, and surface roughness Ra (arithmetic average roughness) of about 0.1 μm or more. Further, the surface of the magnetic substance particle is covered with a resin. The resin content is 3 to 10 percent by mass relative to the total mass of the magnetic substance particles. The degree of circularity of the carrier used in the second aspect is about 0.970 or more.

Ferrite or iron cores are manufactured by a sintering process. Since such cores have large specific gravity, internal cracks of the cores easily occur at the time that the cores are manufactured, and the cores with the internal cracks easily break with stresses in a developing apparatus and that at a transfer nip. However, if magnetic substance particles that have surface roughness Sm (mean spacing between protrusions) of about 2.0 μm or less and surface roughness Ra (arithmetic average roughness) of about 0.1 μm or more are used as the cores, internal cracks of the cores are unlikely to occur at the time that the cores are manufactured, the cores are unlikely to crack in a developing apparatus. Therefore, it is possible to suppress generation of carrier pieces, which may stick into a photoreceptor.

Further, when generation of carrier pieces is suppressed, image defects due to carrier pieces are reduced, and damage of a cleaning blade that comes into contact with a photoreceptor can be suppressed. Therefore, good cleaning characteristics can be obtained, and the life span of the cleaning blade can be lengthened.

1) Core

The magnetic substance core is sintered matter. Therefore, the magnetic substance core more easily cracks than the magnetic substance-dispersed core, in general. Accordingly, due to crack of core particles at the time of manufacture of the magnetic substance carrier, a carrier with the magnetic substance core has a low degree of circularity, and the core has high surface roughness Ra and high surface roughness Sm.

In contrast, the magnetic substance core contained in the carrier used in the second aspect of the invention less cracks at the time of manufacture of the core, which allows the carrier to have an increased degree of circularity. Further, the cores have surface roughness Sm of about 2.0 μm or less, and surface roughness Ra of about 0.1 μm or more.

The magnetic substance cores that have surface roughness Ra and surface roughness Sm within the respective ranges and that allow the carrier to have a degree of circularity within the aforementioned range can be obtained by the following method.

The magnetic substance cores are formed by granulation and sintering. Preferably, a product obtained by granulation and sintering is minutely pulverized to obtain magnetic substance cores to be used in the second aspect. There is no limit to a pulverization method, and the pulverization method may be conducted with any known apparatus. For example, a mortar, a ball mill, and/or a jet mill can be used in the pulverization method. Although a desired final pulverization state of the cores depends on the type of the material of the cores, the average particle diameter of the resultant cores is preferably in the range of about 2 to about 10 μm. The reasons for this are as follows. Core particles having an average particle diameter of less than about 2 μm may be impossible to manufacture. If the average particle diameter is greater than about 10 μm, the cores may have excessively large diameters or a lowered degree of circularity.

Further, the sintering temperature in the second aspect is preferably controlled at a value lower than in conventional methods. A desired sintering temperature depends on the type of the material of the cores. However, the sintering temperature is preferably in the range of about 500 to about 1,200° C., and more preferably in the range of about 600 to about 1,000° C. When the sintering temperature is less than about 500° C., the cores may not have a desired magnetic force. Meanwhile, when the sintering temperature is greater than about 1,200° C., crystal growth is fast, which may result in formation of cores that have an uneven inner structure and that easily break and crack.

In order to complete sintering even at a low temperature, the sintering process preferably includes not only a main sintering step but also preliminary sintering steps. To attain this, the time that the whole of the sintering process takes is preferably long.

When preliminary sintering steps are performed to decrease the temperature necessary for the sintering as described above, it is possible to obtain magnetic substance cores having surface roughness Ra (arithmetic average roughness) of about 0.1 μm or more and surface roughness Sm (mean spacing between protrusions) of about 2.0 μm or less.

In the case of porous magnetic substance cores, even when the surface roughness Ra is large, the surface roughness Sm (mean spacing between protrusions) is greater than about 2.0 μm. The pores of such porous magnetic substance cores easily cause the carrier to chip, which results in generation of carrier pieces. Meanwhile, even when carrier cores have smooth surfaces and have surface roughness Ra of less than 0.1 μm, internal crack of the carrier cores easily occurs, and thus the cores easily crack.

It is necessary that the magnetic substance cores used in the second aspect have surface roughness Ra (arithmetic average roughness) of about 0.1 μm or more. The surface roughness Ra is preferably about 0.2 μm or more, and more preferably about 0.3 μm or more.

Further, it is necessary that the magnetic substance cores used in the second aspect have surface roughness Sm (mean spacing between protrusions) of about 2.0 μm or less. The surface roughness Sm is preferably about 1.8 μm or less, and more preferably about 1.6 μm or less.

The surface roughness Ra (arithmetic average roughness) and the surface roughness Sm (mean spacing between protrusions) are measured as follows. First, the surfaces of 50 carriers magnified by an ultra deep color 3D shape measuring microscope (VK-9500 manufactured by Keyence Corporation) to 3,000 times their actual size are observed.

Regarding the surface roughness Ra (arithmetic average roughness), a roughness curve is obtained from the three-dimensional shape of each of the observed core surfaces, and the absolute values of deviations of measured points on the curve with respect to the average line of the roughness curve are summed up and averaged. The resultant average is used as the surface roughness Ra of the cores. The reference length is 10 μm, and the cut off value is 0.08 mm in obtaining the surface roughness Ra.

Regarding the surface roughness Sm, a roughness curve is obtained, and the intervals of convex portion-to-concave portion cycles are obtained from intersections at which the roughness curve crosses the average line of the curve. The intervals are averaged, and the resultant average is used as the surface roughness Sm (mean spacing between protrusions). The reference length is 10 μm, and the cut off value is 0.08 mm in obtaining the surface roughness Sm.

The measurements of the surface roughness Ra and the surface roughness Sm are performed on the basis of the JIS B 0601 (the edition published in 1994), the disclosure of which is incorporated by reference herein.

Examples of the material of the magnetic substance cores contained in the carrier used in the second aspect include magnetic metals such as iron, steel, nickel, and cobalt, alloys of at least one of these metals and at least one of manganese, chromium, and rare earth elements (e.g. an alloy of nickel and iron, an alloy of cobalt and iron, and an alloy of aluminum and iron), and magnetic oxides such as ferrite and magnetite.

The volume average particle diameter of the cores in the carrier used in the second aspect is preferably about 10 μm to about 500 μm, more preferably about 30 μm to about 150 μm and even more preferably about 30 μm to about 100 μm. When carrier particles having magnetic substance cores with a volume average particle diameter of smaller than about 10 μm are used to form an electrostatic charge image, the adhesion between a toner and the carrier is strong, which results in a decreased amount of the toner used in development. On the other hand, when carrier particles have magnetic substance cores with a volume average particle diameter of more than about 500 μm, a magnetic brush formed by such carrier particles is rough, which makes it difficult to form fine images.

A method for measuring the volume average particle diameter of the cores in the carrier used in the second aspect is the same as that in the carrier used in the first aspect.

3) Coating Layer

In order for the coating layer to sufficiently cover the core surfaces having surface roughness within the aforementioned range, the coating content of the coating layer in the carrier used in the second aspect is preferably about 3 to about 10% by mass with respect to the total mass of the cores, and more preferably about 4 to about 8% by mass. When the coating content is less than about 3% by mass, breakage of the carrier particles cannot be sufficiently suppressed. Meanwhile, when the coating content is greater than about 10% by mass, the carrier particles may flocculate at the time of coating.

The coating content at which the coating layer covers the cores is obtained as follows. Two grams of carrier particles and 20 ml of toluene are put in a beaker having a volume of 100 ml, and the carrier particles and toluene are processed by an ultrasonic cleaner (UT-105 manufactured by SHARP CORPORATION) at an output of 100% for ten minutes. Thereafter, while a magnet is placed on the outer bottom surface of the beaker to dispose the processed particles in the lower portion of the beaker, a supernatant is removed. These processes are repeatedly performed three times, and the resultant bare cores are then dried. Subsequently, the total weight of the cores is measured, and the weight is subtracted from the weight of the carrier particles (two grams) to obtain the amount of the coating layer. The amount is divided by the weight of the cores, and the quotient is multiplied by 100. The product is used as the coating content.

The average thickness of the coating layer is preferably in the range of about 0.1 to about 10 μm, more preferably in the range of about 0.1 to about 3.0 μm, and most preferably in the range of about 0.1 to about 1.0 μm. When the average thickness of the coating layer is smaller than about 0.1 μm, long-term use of such a carrier may cause the coating layer to peel off, which may leads to a decrease in carrier resistance, or it may be difficult to sufficiently suppress breakage of the carrier. Meanwhile, when the average thickness of the coating layer is greater than about 10 μm, it may take a long time for such a carrier to electrically charge a toner to a saturation charge amount.

Examples and the preferred of the material(s) of the coating layer on the magnetic substance core particles are the same as or similar to those of the material of the coating layer on the magnetic powder-dispersed core particles. In addition, a method for forming a coating layer on magnetic substance core particles is the same as or similar to the method for forming a coating layer on magnetic powder-dispersed core particles.

4) Physical Properties of Carrier Used in Second Aspect

The degree of circularity of the carrier used in the second aspect is preferably about 0.970 or more, and more preferably about 0.974 or more. When the degree of circularity is less than about 0.970, such a carrier easily breaks.

The degree of circularity of the carrier used in the second aspect is measured in the same manner as in the first aspect.

In order to obtain a carrier having a degree of circularity within the above range, a method for producing magnetic substance cores preferably includes not only a main sintering step but also at least one preliminary sintering step to decrease the temperature necessary for sintering, and a pulverizing step to obtain particles having a uniform diameter and a uniform composition before the main sintering step.

Further, to obtain a carrier having a degree of circularity within the above range, the coating layer is preferably formed with a fluidized bed device in which core particles that is being dispersed and fluidized in an air flow are sprayed with a coating solution for forming a coating layer.

The saturation magnetization of the carrier used in the second aspect is preferably about 40 emu/g or more, and more preferably about 50 emu/g or more.

This magnetic characteristic of the carrier used in the second aspect is measured in the same manner as in the first aspect.

The volume electric resistance of the carrier used in the second aspect is preferably in the range of about $1\times10^{8}$ to about $1\times10^{15}$ Ω.cm, more preferably in the range of about $1\times10^{8}$ to about $1\times10^{14}$ Ω.cm, and most preferably in the range of about $1\times10^{8}$ to about $1\times10^{13}$ Ω.cm.

When the volume electric resistance of the carrier used in the second aspect is greater than about $1\times10^{15}$ Ω.cm, such a carrier has high resistance and is unlikely to serve as a development electrode at the time of development. As a result, an edge effect may show at solid image portions, resulting in deteriorated solid reproducibility. Meanwhile, when the volume electric resistance of the carrier used in the second aspect is less than about $1\times10^{8}$ Ω.cm, such a carrier has low resistance. As a result, when the concentration of a toner in a developer has become lower than the necessary, electric charge may undesirably migrate from a development roller to the carrier, which may adhere to a latent image.

The volume electric resistance (Ω.cm) of the carrier is measured in the same manner as in the first aspect.

<Toner>

Next, a toner will be described.

Although there is no limit to the materials of the toner used in the invention, the toner contains at least one binder resin and at least one coloring agent.

Each of the at least one binder resin contained in the toner may be a known one for toner particles. Examples thereof include homopolymers and copolymers of the following monomer(s): monoolefins such as ethylene, propylene, butylene, and isoprene; vinyl esters such as vinyl acetate, vinyl propionate, vinyl benzoate, and vinyl butyrate; α-methylene aliphatic monocarboxylic acid esters such as methyl acrylate, phenyl acrylate, octyl acrylate, methyl methacrylate, ethyl methacrylate, butyl methacrylate, and dodecyl methacrylate; vinyl ethers such as vinyl methyl ether, vinyl ethyl ether, and vinyl butyl ether; and vinyl ketones such as vinyl methyl ketone, vinyl hexyl ketone, and vinyl isopropenyl ketone.

Among them, each of the at least one binder resin is typically polystyrene, styrene-alkyl acrylate copolymer, styrene-butadiene copolymer, styrene-maleic anhydride copolymer, or polypropylene. The binder resin may also be polyester, polyurethane, epoxy resin, silicone resin, polyamide, or modified rosin.

There is no limit to the type of each of the at least one coloring agent. Examples of the coloring agent(s) include carbon black, aniline blue, calcoil blue, chrome yellow, ultramarine blue, Du Pont Oil Red, quinoline yellow, methylene blue chloride, phthalocyanine blue, malachite green oxalate, lamp black, Rose Bengal, C.I. Pigment Red 48:1, C.I. Pigment Red 122, C.I. Pigment Red 57:1, C.I. Pigment Yellow 97, C.I. Pigment Yellow 12, C.I. Pigment Blue 15:1, and C.I. Pigment Blue 15:3.

The toner may also contain at least one charge control agent, if necessary. When the toner containing a charge control agent is used as a color toner, the charge control agent is preferably colorless or lightly colored to prevent the charge control agent from affecting the color tone of the color toner. Each of the at least one charge control agent may be a known one, and is preferably an azo metal complex, or a metal complex or salt of salicylic acid or an alkylsalicylic acid.

The toner may also contain any other known component(s) such as an offset-preventive agent, including low molecular weight polypropylene, low molecular weight polyethylene, or wax. Examples of the wax include paraffin wax and derivatives thereof, montan wax and derivatives thereof, microcrystalline wax and derivatives thereof, Fisher-Tropsch wax and derivatives thereof, and polyolefin wax and derivatives thereof. Examples of these derivatives include oxides, polymers obtained by polymerizing one of the above waxes and at least one vinyl monomer, and graft-modified products thereof. The wax may also be alcohol, fatty acid, vegetable wax, animal wax, mineral wax, ester wax, or acid amide.

Further, the toner may also have at least one external additive to control transferability, fluidity, cleaning properties and charge amount of the toner, particularly to improve fluidity. The external additive is inorganic particles adhering to the surfaces of toner mother particles.

Specific examples of the material of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, CaO—$SiO_2$, $K_2O$—$(TiO_2)n$, $Al_2O_3$-$2SiO_2$, $CaCO_3$, $MgCO_3$, $BaSO_4$, and $MgSO_4$. Among these, each of the at least one external additive is preferably silica particles or titania particles to obtain good fluidity of the toner.

The surfaces of the inorganic particles serving as the external additive(s) are preferably hydrophobized. The hydrophobization treatment improves fluidity of the toner, and suppresses dependence of chargeability of the toner on the environment and contamination of the carrier by the toner. The treatment can be carried out by immersing the inorganic particles in a hydrophobizing agent. There is no limit to the type of the agent, and the agent can be a silane coupling agent, a silicone oil, a titanate coupling agent, or an aluminum coupling agent. One of these may be used alone, or two or more kinds of them may be used together. Above all, the agent is preferably a silane coupling agent.

The silane coupling agent is, for example, chlorosilane, alkoxysilane, silazane or a special silylating agent. Specific examples thereof include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltriethoxysilane, decyltrimethoxysilane, hexamethyldisilazane, N,O-(bistrimethylsilyl)acetamide, N,N-(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane and γ-chloropropyltrimethoxysilane. A desired amount of the hydrophobizing agent used depends on, for example, the kind(s) of the inorganic particles. However, the amount of the hydrophobizing agent is generally in the range of about 5 to about 50 parts by weight relative to 100 parts by weight of the inorganic particles.

The degree of hydrophobization of the external additive(s) treated with the hydrophobizing agent(s) is preferably about 40 to 100%, more preferably about 50 to about 90%, and still more preferably about 60 to about 90%.

The degree of hydrophobization in the invention is defined as follows. 0.2 grams of particles are added to 50 cc of water, and the resultant mixture is stirred with a stirrer. Methanol is added to the mixture until all the particles become suspended in the resultant mixed solvent. The total amount of methanol added is regarded as a titration amount T cc. The degree of hydrophobization (M) is calculated by assigning the titration amount to the following formula.

$$\text{Degree of Hydrophobization } (M)=[T/(50+T)]\times 100 \text{ (vol. \%)}$$

The volume average diameter of the toner particles is preferably in the range of about 2 to about 12 μm, more preferably in the range of about 3 to about 10 μm, and most preferably about 4 to about 9 μm. When the volume average diameter of the toner particles is less than about 2 μm, such toner particles may have drastically lowered fluidity, and a developer layer may be therefore insufficiently formed even with a layer regulating member, and fog and/or dirt may occur in images. Meanwhile, when the volume average diameter of the toner particles is greater than about 12 μm, such toner particles may result in lowered resolution, and images with high quality may not be obtained. Further, the toner particles may have a lowered charge amount per developer unit weight. Therefore, it may be difficult to maintain a formed developer layer, and fog and/or dirt may occur in images.

A method of measuring the volume average diameter is as follows. A certain amount (e.g., 0.5 to 50 mg) of a measurement sample is added to two milliliters of an aqueous solution containing 5% by mass of a surfactant or a dispersant, preferably sodium alkylbenzensulfonate. The resultant is added to a certain amount (e.g., 100 to 150 ml) of an electrolytic solution. The resultant suspension in which the sample is suspended in the electrolytic solution is stirred for about one minute with an ultrasonic dispersing apparatus. The particle size distribution of sample particles having a diameter of 2.0 to 60 μm is measured with an apparatus (COULTER MULTISIZER II manufactured by Beckman Coulter Inc.) and an aperture having an aperture diameter of 100 μm. The number of the particles used in the measurement is 50,000.

The whole particle size range of the particle size distribution is divided into several size ranges (channels), and a volume cumulative distribution curve is drawn from the smallest range, and the particle diameter at a cumulant of 50% is regarded as the volume average particle diameter ($D_{50V}$) of the sample.

There is no limit to a method for manufacturing the toner, and the method may be a known method, including a dry manufacturing method such as a kneading pulverization method, or a wet granulating method such as a melting suspension method, an emulsion aggregation method, and a dissolution suspension method.

<Method of Forming Image>

A method for forming a composite color image according to the invention includes electrically charging a latent image-holding member; exposing the charged latent image-holding member to light to form an electrostatic latent image; developing the electrostatic latent image with a two-component developer for developing electrostatic charge images that contains toner particles of one color and a carrier (carrier particles), to form a toner image on the latent image-holding member; primarily transferring the toner image from the latent image-holding member to an intermediate transfer member. In the method, these are repeated, while the toner particles are replaced with toner particles of different color. Thus, a composite color image in which these toner images are superimposed is formed. In addition, the composite color image is secondarily transferred from the intermediate transfer member to a recording medium in the method. The number of the toner images that form the composite color image is two or more, and the composite color image may be a full-color image.

In the method, the intermediate transfer member is a belt (intermediate transfer belt) that has a substrate whose Young's modulus is in the range of about 3,000 to about 6,500 MPa. During the primary transferring in the method, primary transfer nip pressure is in the range of about 8 to about 20 gf/cm, and a value (T/P) obtained by dividing a primary transfer current value T μA by a processing speed P mm/sec is in the range of about 0.08 to about 0.18.

The carrier contained in the two-component developer used in the image formation is the carrier used in the first or second aspect. There is no limit to the type of the toner contained in the two-component developer, but the toner may be the aforementioned toner. At least one of known techniques may be suitably applied to the toner.

In the method of forming a composite color image, at least one of known techniques may be applied to each of the charging, the exposure, the development, and the secondary transferring. The method may further include cleaning the latent image-holding member after the primary transferring, and fixing the toner image on the recording medium.

Hereinafter, the method of forming a composite color image of the invention will be described in detail with reference to the image forming apparatus shown in the drawings.

First, the basic structure of an exemplary embodiment of an image forming apparatus used in the invention is schematically shown in FIG. 1.

An image forming apparatus 200 shown in FIG. 1 is a full-color image forming apparatus including an intermediate transfer member.

The image forming apparatus 200 has a housing 400, and, in the housing 400, an intermediate transfer belt 409 and four electrophotographic photoreceptors 401*a* to 401*d* disposed along the intermediate transfer belt 409. Each of the electrophotographic photoreceptors 401*a* to 401*d* has a conductive substrate and a photosensitive layer.

For example, yellow, magenta, cyan and black images can be formed on the electrophotographic photoreceptors 401*a*, 401*b*, 401*c*, and 401*d*, respectively.

The electrophotographic photoreceptors 401*a* to 401*d* can respectively rotate in predetermined directions (counterclockwise in FIG. 1). Charging rolls 402*a* to 402*d*, developing units 404*a* to 404*d*, primary transfer rolls 410*a* to 410*d*, and cleaning blades 415*a* to 415*d* are placed around the respective photoreceptors 401*a* to 401*d* along the rotation direction of the photoreceptors 401*a* to 401*d*. Toners having four colors of black, yellow, magenta, and cyan are respectively stored in toner cartridges 405*a* to 405*d* and can be respectively supplied to the developing units 404*a* to 404*d*. The primary transfer rolls 410*a* to 410*d* press against the respective electrophotographic photoreceptors 401*a* to 401*d* via the intermediate transfer belt 409.

In addition, an exposure unit 403 is placed at a certain position in the housing 400, and can emit laser beams, with which the surfaces of the electrically charged electrophotographic photoreceptors 401*a* to 401*d* are irradiated. Electrical charging, exposure, development, primary transfer, and cleaning are conducted in that order, with each of the electrophotographic photoreceptors 401*a* to 401*d* rotating. Toner images of the four colors are sequentially transferred and superimposed on the intermediate transfer belt 409.

The charging rolls 402*a* to 402*d* are contact-type conductive members and are brought into contact with the surfaces of the respective electrophotographic photoreceptors 401*a* to 401*d* so as to uniformly apply a voltage to the corresponding photoreceptor and to electrically charge the surface of the photoreceptor to a predetermined potential (Electrical charging).

In this exemplary embodiment, each of the charging rolls can be replaced with any other contact-type charging member such as a charging brush, a charging film or a charging tube, or with a contact-less charging member such as a corotron or a scorotron.

The exposure unit 403 can be an optical system having light sources each of which can irradiate the surface of the corresponding electrophotographic photoreceptor 401*a*, 401*b*, 401*c* or 401*d* in a desired image pattern, such as a semiconductor laser, a light-emitting diode (LED), or a liquid crystal shutter. When the exposure unit can emit non-interference light, interference fringes can be prevented from occurring between the conductive substrate and the photosensitive layer of each of the electrophotographic photoreceptors 401*a* to 401*d*. The exposure unit 403 may have only one light source, if possible.

Each of the developing units 404*a* to 404*d* can be an ordinary developing device, which makes the toner of the two-component developer for developing electrostatic charge images adhere to a latent image in a contact or non-contact manner to develop the latent image (development). The developing device needs to allow use of the two-component developer for developing electrostatic charge images, and otherwise there is no limit thereto. Each of the developing units can be one appropriately selected from known developing devices according to the intended purpose.

In the primary transferring, a primary transfer bias that has a polarity opposite to that of the charged toner on the latent image-holding member is applied to each of the primary transfer rolls 410*a* to 410*d*, so that the toner images of the respective colors are sequentially transferred from the latent image-holding members to the intermediate transfer belt 409.

In the invention, the primary transfer nip pressure applied by each of the primary transfer rolls 410*a* to 410*d* that serve as primary transfer units is in the range of about 8 to about 20 gf/cm, preferably in the range of about 9 to about 18 gf/cm, and more preferably in the range of about 9 to about 16 gf/cm. When the primary transfer nip pressure is less than about 8 gf/cm, the toner images may be insufficiently transferred. Meanwhile, when the primary transfer nip pressure is greater than about 20 gf/cm, the carrier may easily break under such nip pressure.

The current applied to each of the primary transfer rolls 410*a* to 410*d* (primary transfer current value T) is preferably in the range of about 5 to about 50 μA, more preferably in the range of about 10 to about 40 μA, and most preferably in the range of about 10 to about 30 μA. When the applied current is less than 5 μA, the toner images may be insufficiently transferred. Meanwhile, when the applied current is greater than about 50 μA, the carrier particles easily chip to generate carrier pieces (broken fine particles), and the carrier pieces may adhere to the photoreceptor, stand up thereon and stick into the photoreceptor.

The conveying speed (processing speed) P of the intermediate transfer belt 409 is preferably in the range of about 50 to about 350 mm/sec, more preferably in the range of about 60 to about 320 mm/sec, and most preferably in the range of about 80 to about 300 mm/sec. When the conveying speed is less than about 50 mm/sec, such a speed does not match the recent trend of rapid process. Meanwhile, when the conveying speed is greater than about 350 mm/sec, toner images may be insufficiently transferred.

Further, in the primary transfer conducted by each of the primary transfer units, the value (T/P) obtained by dividing the primary transfer current T (μA) by the processing speed P (mm/sec) is in the range of about 0.08 to about 0.18. The value (T/P) is preferably in the range of about 0.09 to about 0.17, and more preferably in the range of about 0.09 to about 0.16. When the value (T/P) is less than about 0.08, toner images may be insufficiently transferred. Meanwhile, when the value (T/P) is greater than about 0.18, carrier pieces may easily stick into the electrophotographic photoreceptors.

The cleaning blades 415*a* to 415*d* are used to remove the toner remaining on the surface of the corresponding electrophotographic photoreceptor after the primary transferring. The electrophotographic photoreceptors are cleaned by these cleaning blades 415*a* to 415*d* and repeatedly used in the image forming method of the invention. Each of the cleaning blades is made of, for example, urethane rubber, neoprene rubber, or silicone rubber.

Subsequently, explanations for the method for forming a composite color (e.g., full-color) image according to the invention will be continued with reference to the image forming apparatus 200 shown in FIG. 1.

The intermediate transfer belt 409 is wound around a driving roll 406, a backup roll 408 and a tension roll 407, and is tensioned at a predetermined tension. The intermediate transfer belt 409 can be rotated without generating flexure, with these rollers rotating. A secondary transfer roll 413 is so disposed as to press against the backup roll 408 via the intermediate transfer belt 409.

A secondary transfer bias voltage that has a polarity opposite to that of the charged toners on the intermediate transfer belt is applied to the secondary transfer roll 413, secondarily transferring the full-color toner image from the intermediate transfer belt to the recording medium 500.

After the intermediate transfer belt 409 passes through the nip between the backup roll 408 and the secondary transfer roll 413, the intermediate transfer belt 409 is cleaned by, for example, a cleaning blade 416 disposed near the driving roll 406, or a static eliminator (not shown), and is then used to the next image forming process.

A tray (tray for recording media) 411 is provided at a predetermined location inside the housing 400, and stores recording media 500 such as paper. The recording media 500 from the tray 411 are conveyed one by one with conveying rollers 412, and thereby sequentially pass through the nip between the intermediate transfer belt 409 and the secondary transfer roll 413, and the nip between two fixation rolls 414 that come into contact with each other, and are then discharged out of the housing 400.

Next, the intermediate transfer belt that is used in the invention will be described.

The intermediate transfer belt used in the invention has a substrate, and there is no limit to the other components of the intermediate transfer belt.

For example, where a photoconductive layer that, when the photoconductive layer is not being irradiated with light, is dielectric and has a high volume resistivity, and, when the photoconductive layer is being irradiated with light, is electrically conductive is disposed on the substrate as a surface layer, the volume resistivity of the photoconductive layer that is being irradiated with light is different from that of the photoconductive layer that is not being irradiated with light. Therefore, irradiation of the intermediate transfer belt (medium) that has been subjected to the secondary transfer with light emitted by a static charge-eliminating lamp to make the photoconductive layer electrically conductive removes charges remaining on the intermediate transfer belt. Thus, the light irradiation allows good cleaning of the intermediate transfer belt.

Further, providing the substrate with a surface-protecting layer can improve abrasion resistance of the intermediate transfer belt, and lengthen the life span of the intermediate transfer belt.

Hereinafter, each of the elements of the intermediate transfer belt will be described.

Substrate

The Young's modulus of the substrate of the intermediate transfer belt used in the invention is about 3,000 MPa or more to prevent color misalignment at the time of transfer, and is restricted to about 6,500 MPa or less due to restrictions at the time of manufacture of the substrate. However, there is no limit to the other properties of the substrate. The Young's modulus is preferably in the range of about 3,500 to about 6,000 MPa.

The substrate having Young's modulus within the above range can be made of, for example, polyimide resin.

Further, the tensile modulus (Young's modulus) of the substrate in the invention can be measured with an apparatus (FA1015A manufactured by AIKOH ENGINEERING CO., LTD.) on the basis of JIS K 6251:93. In the measurement, a piece cut from the substrate and having a rectangular surface with dimensions of 5 mm×40 mm is used as a measurement sample, and the test speed is set at 20 mm/min.

The substrate in the invention is preferably semi-conductive, and the volume resistivity thereof is preferably in the range of about $1\times10^{8}$ to about $1\times10^{13}$ Ωcm, and more preferably in the range of about $1\times10^{9}$ to about $1\times10^{12}$ Ωcm. When the substrate of the intermediate transfer belt in the image forming apparatus used in the invention has a low volume resistivity of less than about $1\times10^{8}$ Ωcm, the transfer voltage actually applied to the primary transfer zone in the image forming apparatus may be less than the necessary. Meanwhile, when the volume resistivity of the substrate is greater than about $1\times10^{13}$ Ωcm, charges remaining on the intermediate transfer belt may be insufficiently eliminated.

The substrate may be made of at least one resin. Examples of the resin(s) include polyimide resin, polyamide-imide resin, fluorinated resin, vinyl chloride-vinyl acetate copolymer, polycarbonate (PC), polyethylene terephthalate (PET), vinyl chloride resin, ABS resin, polyester resin such as polymethyl methacrylate (PMMA) and polybutyrene terephthalate (PBT), and polyamide (PA). One of these resins may be used alone, or two or more of them may be used together. The resin is preferably polyimide resin among them, since the polyimide resin is not affected by the temperature during coating and drying of a charge transport layer, a charge generating layer and an undercoat layer, and has excellent structural strength and excellent bending fatigue resistance.

The polyimide resin is obtained by reacting, for example, at least one aromatic tetracarboxylic acid component and at least one aromatic diamine component in at least one organic polar solvent. Examples of the aromatic tetracarboxylic acid component include pyromellitic acid, naphthalene-1,4,5,8-tetracarboxylic acid, naphthalene-2,3,6,7-tetracarboxylic acid, 2,3,5,6-biphenyltetracarboxylic acid, 2,2',3,3'-biphenyltetracarboxylic acid, 3,3', 4,4'-biphenyltetracarboxylic acid, 3,3',4,4'-diphenyl ether tetracarboxylic acid, 3,3',4,4'-benzophenonetetracarboxylic acid, 3,3',4,4'-diphenylsulfone tetracarboxylic acid, 3,3',4,4'-azobenzenetetracarboxylic acid, bis(2,3-dicarboxyphenyl)methane, bis(3,4-dicarboxyphenyl)methane, β,β-bis(3,4-dicarboxyphenyl)propane, and β,β-bis(3,4-dicarboxyphenyl)hexafluoropropene, and mixtures thereof.

Examples of the aromatic diamine component include m-phenyldiamine, p-phenyldiamine, 2,4-diaminotoluene, 2,6-diaminotoluene, 2,4-diaminochlorobenzene, m-xylilenediamine, p-xylilenediamine, 1,4-diaminonaphthalene, 1,5-diaminonaphthalene, 2,6-diaminonaphthalene, 2,4'-diaminonaphthalenebiphenyl, benzidine, 3,3-dimethylbenzidine, 3,3'-dimethoxybenzidine, 3,4'-diaaminodiphenyl ether, 4,4'- diaminodiphenyl ether (oxy-p,p'-dianiline, or ODA), 4,4'-diaminodiphenyl sulfide, 3,3'-diaminobenzophenone, 4,4'-diaminophenylsulfone, 4,4'-diaminoazobenzene, 4,4'-diaminodiphenyl methane, and β,β-bis(4-aminophenyl) propane.

Examples of the organic polar solvent include N-methyl-2-pyrrolidone, N,N-dimethylacetamide, dimethylsulfoxide, and hexamethylphosphortriamide.

The at least one organic polar solvent may be mixed with at least one of phenols such as cresol, phenol, and xylenol, and hydrocarbons such as hexane, benzene, and toluene, if necessary.

In order to obtain a volume resistivity (electric resistance) within the aforementioned range, the substrate may contain at least one conductive agent for providing electronic conductivity and/or at least one conductive agent for providing ionic conductivity, if necessary.

Each of the at least one conductive agent for providing electronic conductivity may be carbon black, graphite, metal or an alloy such as aluminum, nickel or a copper alloy, or metal oxide such as tin oxide, zinc oxide, or composite oxide (e.g., tin oxide-indium oxide or tin oxide-antimony oxide), or potassium titanate. Each of the at least one conductive agent for providing ionic conductivity may be sulfonate, an ammonia salt, or a cationic, anionic, or nonionic surfactant.

The substrate may further include at least one conductive polymer as well as the aforementioned resin. Examples of the conductive polymer include polymers to which at least one quaternary ammonium group is bonded, such as copolymers, the monomers of each of which include at least one (meth) acrylate monomer having at least one group obtained by bonding a quaternary ammonium group to a carboxyl group and other monomer(s) (for example, styrene), and copolymers of maleimide to which at least one quaternary ammonium group is bonded, and methacrylate; polymers having at least one alkali metal salt of sulfonic acid such as sodium polysulfonate; polymers having at least one hydrophilic unit of alkyloxide in the molecular chain thereof such as polyethylene oxide, polyethylene glycol-based polyamide copolymer, polyethylene oxide-epichlorohydrin copolymer, polyetheramideimide, block polymers having polyether as the main segment thereof; and polyaniline, polythiophene, polyacetylene, polypyrrole, and polyphenylenevinylene. These conductive polymers may be used in a dedoped state or a doped state. Use of at least one of the conductive agents, the conductive polymers, and at least one surfactant can provide stable electrical resistance within the aforementioned range.

The conductive agent in the invention is preferably acidic carbon black having pH of about 5 or less. The reasons for this are as follows. Such acidic carbon black is well dispersed in a resin composition and therefore has good dispersion stability. Moreover, an intermediate transfer belt including such acidic carbon black has decreased degrees of unevenness of resistance and dependency on an electric field, and does not easily undergo electric filed concentration, which may be caused by transfer voltage, and therefore has improved stability of electric resistance over time.

The pH value of the acidic carbon black is preferably about 5.0 or less, more preferably about 4.5 or less, and most preferably about 4.0 or less. The reason why the acidic carbon black having pH of about 5.0 or less is well dispersed in a resin composition and therefore has good dispersion stability and the intermediate transfer belt including such acidic carbon black has decreased degrees of unevenness of resistance and dependency on an electric field, and does not easily undergo electric filed concentration, which may be caused by transfer voltage, is that the acidic carbon black has on the surface thereof at least one oxygen-containing functional group such as a carboxyl group, a hydroxy group, a quinone group, or a lactone group.

The pH of the carbon black is obtained by preparing the aqueous suspension of the carbon black and measuring the pH of the aqueous suspension. In the measurement, glass electrodes are used. The pH of the carbon black can be adjusted by controlling conditions such as the temperature and/or time of an oxidization process.

The oxidized (acidic) carbon black having pH of about 5.0 or less includes at least one volatile component. The content of the volatile component(s) therein is preferably in the range of about 1 to about 25%, more preferably in the range of about 3 to about 20%, and most preferably in the range of about 3.5 to about 15%. When the content of the volatile component(s) is less than about 1%, the effect of the oxygen-containing functional group(s) on the surface of the carbon black may not show, and the carbon black may have low dispersibility in a binder resin. Meanwhile, when the content of the volatile component(s) is greater than about 25%, the carbon black may decompose in dispersing it in a resin composition. In addition, an increased amount of water is adsorbed by the oxygen-containing functional group(s) present on the surface of the carbon black, and thus the substrate used in the invention may have deteriorated appearance.

In contrast, controlling the content of the volatile component(s) within the range of about 1 to about 25% can more improve dispersibility of the carbon black in a resin composition. The content of the volatile component(s) may be a ratio of the amount of at least one organic volatile component (e.g., a carboxyl group, a hydroxy group, a quinone group, and/or a lactone group) obtained by heating carbon black at 950° C. for seven minutes to that of the carbon black.

The substrate of the intermediate transfer belt may contain two or more kinds of carbon black components. In this case, these carbon black components preferably have substantially different conductivities. For example, carbon black components that have different properties such as a degree of oxidization, DBP oil absorption, or a specific surface areas measured by a BET method using nitrogen absorption can be used. When the substrate contains two or more kinds of carbon black components having different conductivities, the surface resistivity of the substrate can be adjusted at a desired value by, for example, adding carbon black having high conductivity and then adding carbon black having low conductivity to the other components of the raw materials of the substrate. When the substrate contains two or more kinds of carbon black components, use of oxidized carbon black having pH of about 5.0 or less as one of the two or more kinds of carbon black components can improve mixing properties and dispersion of these carbon black components.

As aforementioned, the acidic carbon black having pH of about 5.0 or less is superior in dispersion in a resin composition to ordinary carbon black, because of the effect of the oxygen-containing functional group(s) existing on the surface. Accordingly, the amount of such carbon black serving as conductive powder is preferably higher than that of ordinary carbon black. In this case, the substrate has an increased content of carbon black, and it is possible to make the most of the effect of the oxidized carbon, such as suppression of in-plane unevenness of electric resistance value.

The content of the acidic carbon black having pH of 5.0 or less in the substrate used in the invention is so set as to adjust the volume resistivity (electric resistance) of the intermediate transfer member within the aforementioned preferred range. Specifically, the content of the acidic carbon black is preferably in the range of about 10 to about 30% by mass, which enables the acidic carbon black to display the effect, such as suppression of in-plane unevenness of surface resistivity of the intermediate transfer member. When the content of the acidic carbon black having pH of about 5.0 or less is less than about 10% by mass, the intermediate transfer member may have uneven electric resistance, and therefore may have in-plane unevenness of surface resistivity and an increased degree of dependency on an electric field. Meanwhile, when the content of the oxidized carbon black having pH of about 5.0 or less is greater than about 30% by mass, the intermediate transfer member may not have a desired resistance value. The content of the oxidized carbon black having pH of about 5.0 or less is more preferably in the range of about 18 to about 30% by mass. Inclusion of the oxidized carbon black having pH of about 5.0 or less at a content within the range of about 18 to about 30% by mass enables making the most of the effect of the carbon black and may suppress in-plane unevenness of resistance and dependency on an electric field.

Surface Layer

As aforementioned, the intermediate transfer belt in the invention may have, as a surface layer, a photoconductive layer that when the photoconductive layer is not being irradiated with light, is dielectric and has a high volume resistivity, and, when the photoconductive layer is being irradiated with light, is electrically conductive. When the photoconductive layer is not being irradiated with light, the photoconductive layer has the volume resistivity of a dielectric substance. Meanwhile, when the photoconductive layer is not being irradiated with light, the photoconductive layer shows conductivity. Thus, the resistivity of the photoconductive layer changes by irradiating the layer with light.

When the image forming apparatus used in the invention has such an intermediate transfer belt, the primary transfer and the secondary transfer are performed at the time that the intermediate transfer belt is not being irradiated with light. At this time, the intermediate transfer belt has a volume resistivity as high as that of a dielectric substance. When a transfer voltage is applied to the intermediate transfer belt that has such a high volume resistivity, the transfer field does not spread, and a toner may be prevented from scattering. Thereby, it is possible to obtain an excellent transferred image.

In the invention, the phrase "having high volume resistivity" means that the volume resistivity of the photoconductive layer, as a surface layer, which is being irradiated with light, is about $1\times10^{13}$ Ωcm or more. The volume resistivity of the photoconductive layer that is being irradiated with light is preferably about $1\times10^{14}$ Ωcm or more.

The photoconductive layer may be obtained by adding at least one photoconductive substance to at least one of materials generally used in surface layers of intermediate transfer belts, or may be the same as the photosensitive layer of an electrophotographic photoreceptor. In addition, the photoconductive layer may have a multi-layered structure that includes a charge transport layer and a charge generating layer.

Hereinafter, a photoconductive layer having a charge transport layer and a charge generating layer and serving as the surface layer of an intermediate transfer member will be described. The charge generating layer has a function of generating charges when the photoconductive layer is being irradiated with light. The charge transport layer has functions of being dielectric and having a high volume resistivity when the photoconductive layer is not being irradiated with light and, when the photoconductive layer is being irradiated with light, transporting charges in the form of carriers, namely electrons, which have negative polarity, or holes, which have positive polarity.

Figure 2A:
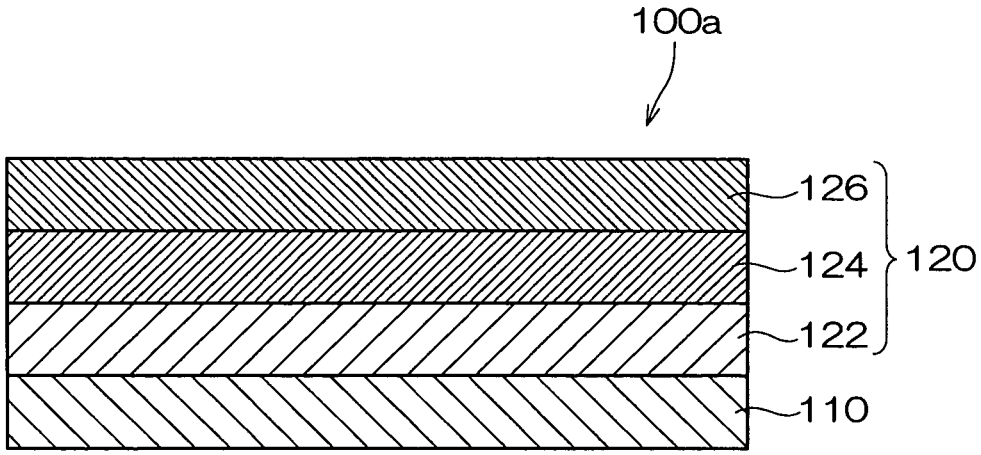
FIG. 2A is a cross-sectional view schematically illustrating the structure of an intermediate transfer belt 100*a* usable in the invention.

Hereinafter, the respective layers of the multi-layered structure of such a photoconductive layer will be described with reference to FIGS. 2A and 2B. FIG. 2A is a cross-sectional view schematically illustrating the structure of an intermediate transfer belt 100*a* usable in the invention, and FIG. 2B is a cross-sectional view schematically illustrating the structure of an intermediate transfer belt 100*b* usable in the invention.

The intermediate transfer belt 100*a* having a structure shown in FIG. 2A includes a substrate 110 and a photoconductive layer 120. The photoconductive layer 120 includes an undercoat layer 122, a charge generating layer 124, and a charge transport layer 126.

Figure 2B:
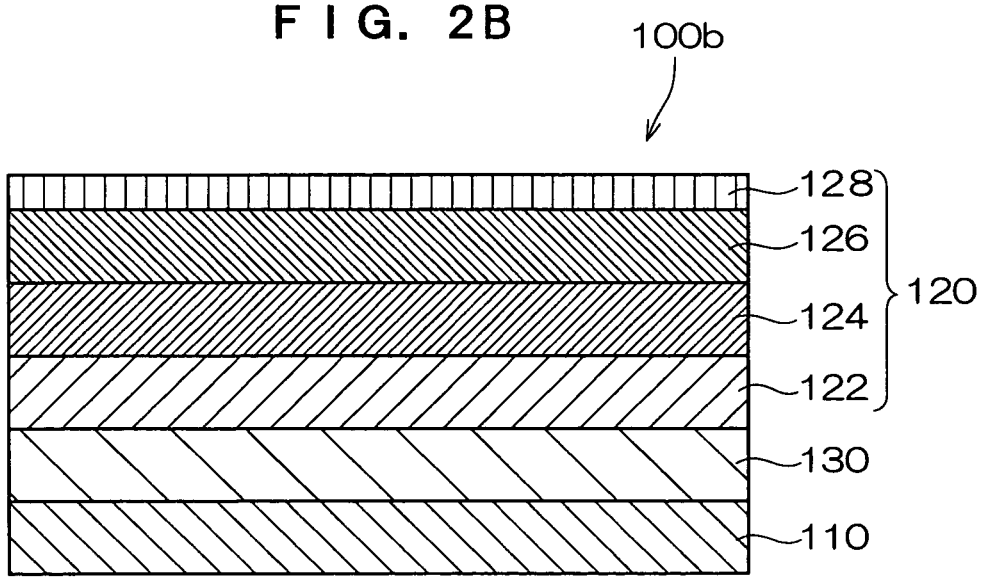
FIG. 2B is a cross-sectional view schematically illustrating the structure of an intermediate transfer belt 100*b* usable in the invention.

The intermediate transfer belt 100*b* having a structure shown in FIG. 2B includes a substrate 110, a photoconductive layer 120, and an intermediate layer (elastic layer) 130 provided between the substrate 110 and the photoconductive layer 120. The photoconductive layer 120 may include an undercoat layer 122, a charge generating layer 124, a charge transport layer 126, and a surface-protecting layer 128. The intermediate layer 130 may be a single layer or may be composed of two or more sub-layers.

As the substrates shown in FIGS. 2A and 2B, the aforementioned substrate is used.

The charge generating layer is provided between the substrate or the undercoat layer and the charge transport layer, and has a function of generating charges when the photoconductive layer is being irradiated with light. The charge generating layer is formed by vacuum-depositing at least one charge generating material, or by mixing at least one charge generating material with at least one organic solvent and at least one binder resin, and coating the resultant dispersion liquid on the substrate or the undercoat layer.

Examples of the charge generating material(s) contained in the charge generating layer include inorganic photoconductive substances such as amorphous selenium, crystalline selenium, an alloy of selenium and tellurium, an alloy of selenium and arsenic, other selenium compounds and selenium alloys, zinc oxide, and titanium oxide, and materials obtained by subjecting those substances to colorant sensitization; and various organic pigments and dyes such as various phthalocyanine pigments, including metal-free phthalocyanine, titanyl phthalocyanine, copper phthalocyanine, tin phthalocyanine, and gallium phthalocyanine, squarylium colorants, anthoanthrone colorants, perylene colorants, azo colorants, anthraquinone colorants, pyrene colorants, pyrylium salts, and thiapyrylium salts. These organic pigments generally have plural crystal forms. In particular, it is known that phthalocyanine pigments have various crystal forms such as a α form and a β form. When the charge generating substance contained in the charge generating layer is one of these organic pigments, the charge generating substance may have any of crystal forms that have a property or properties (e.g., sensitivity) suitable for the intended purpose of the charge generating layer.

In the invention, each of the at least one charge generating material is preferably one of the following compounds having excellent properties: hydroxygalliumphthalocyanine whose typical crystal form has diffraction peaks at Bragg angles (2θ±0.20) of 7.6°, 10.0°, 25.2°, and 28.0° in the X-ray diffraction spectrum obtained by using a Cukα ray, chlorgalliumphthalocyanine whose typical crystal form has diffraction peaks at Bragg angles (2θ±0.2°) of 7.3°, 16.5°, 25.4°, and 28.1° in the X-ray diffraction spectrum obtained by using a Cukα ray, and titanyl phthalocyanine whose typical crystal form has diffraction peaks at Bragg angles (2θ±0.2°) of 9.5°, 24.2°, and 27.3° in the X-ray diffraction spectrum obtained by using a Cukα ray.

In X-ray diffraction spectra practically measured, the Bragg angles at which peaks appear may be slightly shifted from the angles described in the above explanations. The causes of this are the crystal form of a sample used in the measurement and the measuring method. However, if the pattern of an X-ray diffraction spectrum practically measured is substantially the same as one of the patterns of the above explanations, it can be thought that the crystal form of the sample used in the measurement is the same as that of the compound having the one of the patterns of the explanations. In the invention, one of the aforementioned charge generating materials may be used alone, or two or more of them may be used together.

The charge generating layer may contain at least one binder resin. Examples of the at least one binder resin include polycarbonate resin and copolymer thereof (e.g., those whose monomer(s) includes at least one of bisphenol A and bisphenol Z); polyarylate resin; polyester resin; methacrylic resin; acrylic resin; polyvinyl chloride resin; polystyrene resin; polyvinyl acetate resin; styrene-butadiene copolymer resin; vinylidene chloride-acrylonitrile copolymer resin; a vinyl chloride-vinyl acetate-maleic anhydride resin; silicone resin; silicone-alkyd resin; phenol-formaldehyde resin; styrene-alkyd resin; and poly-N-vinylcarbazole.

One of these binder resins may be used alone, or two or more of them may be used together. The compounding ratio (mass ratio) of the charge generating material(s) to the binder resin(s) is preferably in the range of 10:1 to 1:10. The charge generating material(s) can be dispersed in the binder resin(s) with a disperser such as a roll mill, a ball mill, a vibration ball mill, an attritor, a DYNO-mill, a sand mill or a colloid mill.

The thickness of the charge generating layer is generally in the range of about 0.01 to about 5 μm, and preferably in the range of about 0.05 to about 2.0 μm.

The amount of light absorbed by the charge generating layer depends on the thickness of the charge generating layer. When the charge generating layer is thick, the charge generating layer absorbs an increased amount of light. Therefore, even when the photoconductive layer as a whole is uneven in thickness, the photoconductive layer may have a decreased degree of unevenness in sensitivity with respect to light and may provide an intermediate transfer member with improved in-plane uniformity of transfer efficiency.

In contrast, the amount of light reflected by the charge generating layer is affected by the absorption coefficient of the pigment contained in the charge generating layer with respect to irradiation light, the compounding ratio of the pigment(s) to the binder resin(s), and the dispersion state of the pigment(s), in addition to the thickness of the charge generating layer. Therefore, the amount of light reflected is not defined from the thickness of the charge generating layer alone.

The charge transport layer is provided on the charge generating layer and, when the charge transport layer is not being irradiated with light, is dielectric and has a high volume resistivity and, when the charge transport layer is being irradiated with light, transports charges in the form of carriers, namely electrons, which have negative polarity, or holes, which have positive polarity. The charge transport layer is formed by dissolving at least one charge transport material and at least one binder resin in at least one proper solvent and coating the resultant solution on the charge generating layer or the intermediate layer.

Examples of the charge transport material(s) include hole transport materials such as oxadiazole derivatives, pyrazoline derivatives, aromatic tertiary amino compounds, aromatic tertiary diamino compounds, 1,2,4-triazine derivatives, hydrazone derivatives, benzofuran derivatives, α-stilbene derivatives, enamine derivatives, carbazole derivatives, and poly-N-vinylcarbazole and derivatives thereof; quinone compounds, tetracyanoquinodimethane compounds, fluorenone compounds, oxadiazole compounds, xanthone compounds, thiophene compounds, and diphenoquinone compounds; and polymers having a main chain and/or at least one branched chain that contains at least one of groups derived from these compounds.

One of these charge transport materials can be used alone, or two or more of them can be used together.

The polarity that a photoconductive layer should have at the time that the photoconductive layer has been electrically charged depends on the polarity of charges that can be transported by a charge transport material. Therefore, the polarity that an intermediate transfer belt should have on its photoconductive layer at the time that the photoconductive layer has been electrically charged depends on the polarity of charges that can be transported by the charge transport material. When the charge transport layer of an intermediate transfer belt contains a hole transport material, the intermediate transfer belt is negatively charged. When the charge transport layer of an intermediate transfer belt contains an electron transport material, the intermediate transfer belt is positively charged. When the charge transport layer of an intermediate transfer belt contains both an electron transport material and a hole transport material, the intermediate transfer belt is positively and negatively charged.

The charge transport layer may contain at least one binder resin. Each of the at least one binder resin may be any of those usable as such. However, it is preferred that the binder resin has compatibility with the charge transport material and appropriate strength.

Examples of the at least one binder resin include polycarbonate resin and copolymer thereof (e.g., those whose monomer(s) includes at least one of bisphenol A, bisphenol Z, bisphenol C and bisphenol TP); polyarylate resin and copolymer thereof; polyester resin; methacrylic resin; acrylic resin; polyvinyl chloride resin; polyvinylidene chloride resin; polystyrene resin; polyvinyl acetate resin; styrene-butadiene copolymer resin; vinyl chloride-vinyl acetate copolymer resin; vinyl chloride-vinyl acetate-maleic anhydride terpolymer resin; silicone resin; silicone-alkyd resin; phenol-formaldehyde resin; styrene-acrylic copolymer resin; styrene-alkyd resin; poly-N-vinylcarbazole resin; polyvinyl butyral resin; and polyphenylene ether resin. One of these binder resins may be used alone, or two or more of them may be used together.

A desired molecular weight of each of the at least one binder resin used in the invention is appropriately determined in consideration of film forming conditions such as the thickness of the photoconductive layer or the type of the solvent. However, the viscosity-average molecular weight of each binder resin is preferably in the range of about 3,000 to about 300,000, and more preferably in the range of about 20,000 to about 200,000.

The charge transport layer can be formed by coating and drying a coating solution obtained by dissolving at least one charge transport material and at least one binder resin in an appropriate solvent. Examples of the solvent used to form a charge transport layer include aromatic hydrocarbons such as benzene, toluene and chlorobenzene; ketones such as acetone and 2-butanone; halogenated aliphatic hydrocarbons such as methylene chloride, chloroform and ethylene chloride; cyclic or straight chain ethers such as tetrahydrofuran, dioxane, ethylene glycol and diethyl ether; and mixtures thereof.

In order to obtain a coating layer having improved smoothness, the coating solution may further contain silicone oil as a leveling agent.

A coating method for each of the layers of an intermediate transfer member can be selected from an immersion coating method, a ring coating method, a spray coating method, a bead coating method, a blade coating method, a roller coating method, a knife coating method, and a curtain coating method according to the shape and/or usage of the intermediate transfer member. The resultant coating layer is preferably dried as follows. The coating layer is first dried at room temperature. When a certain time has lapsed since the drying, the dry state of the coating layer is checked by lightly touching a finger to the coating layer. When the coating layer has been dried so as not to soil the finger, the coating layer is then heated to completely dry the layer. The heating dry is preferably performed at a temperature of about 30 to about 200° C. for a period of time in the range of about five minutes to about two hours. The compounding ratio (mass ratio) of the charge transport material(s) to the binder resin(s) is preferably in the range of 10:1 to 1:5.

The thickness of the charge transport layer is generally in the range of about 5 to about 50 μm, and preferably in the range of about 10 to about 40 μm.

The charge transport layer may contain at least one additive, such as an antioxidant, a light stabilizer, or a heat stabilizer to prevent ozone or acidic gas generated in an electrophotographic apparatus, or light or heat from degrading the intermediate transfer member.

Examples of the antioxidant include hindered phenol, hindered amine, paraphenylenediamine, arylalkane, hydroquinone, spirochroman, spiroindanone, and derivatives thereof, organic sulfur-containing compounds and organic phosphorous-containing compounds.

The charge transport layer may further contain at least one electron-accepting material to improve sensitivity of the charge transport layer, and reduce the residual potential and a degree of fatigue at the time of repeated use of the intermediate transfer member.

Examples of the electron-accepting material(s) used in the charge transport layer in the invention include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid and phthalic acid. Among these, each of the at least one electron-accepting material is preferably fluorenone, quinone, or a derivative thereof, or a benzene derivative having at least one electron-attractive substituent such as Cl, CN or $NO_2$.

When the charge transport layer is the surface layer of the intermediate transfer member, the charge transport layer may contain releasable solid particles made of fluorinated resin such as TEFLON (fluorinated resin particles) to improve the smoothness of the surface thereof.

The content of the fluorinated resin particles in the charge transport layer is preferably in the range of about 0.1 to about 40% by mass with respect to the entire amount of the charge transport layer, more preferably in the range of about 1 to about 30% by mass, and most preferably in the range of about 1 to about 20% by mass. When the content of the fluorinated resin particles is less than about 1% by mass, the modifying effect derived from dispersion of the fluorinated resin particles may be insufficient. Meanwhile, when the content of the fluorinated resin particles is greater than about 40% by mass, the charge transport layer may have lowered light transmittance and the residual potential of the charge transport layer due to repetitive use of the intermediate transfer member may increase. The average primary diameter of the fluorinated resin particles is preferably in the range of about 0.05 to about 1 μm, and more preferably in the range of about 0.1 to about 0.5 μm.

In the invention, the fluorinated resin particles may be contained in the surface layer of a latent image-holding member. As described later, a paper conveying belt in the invention is preferably a fluorinated resin belt, or may have a surface layer made of fluorinated resin. A combination of such a paper conveying belt and the intermediate transfer member makes it possible to reduce frequency of positional misalignment at the frictional portion between the intermediate transfer belt and the latent image-holding member in the primary transfer zone and that at the frictional portion between the intermediate transfer belt and the paper conveying belt in the secondary transfer zone.

When the surface layer of the latent image-holding member contains fluorinated resin particles, the fluorinated resin particles may be contained in the charge transport layer or the surface-protecting layer serving as the outermost layer of the latent image-holding member in the same manner as in the intermediate transfer belt in the invention.

The charge transport layer of the intermediate transfer member may further contain inorganic particles in addition to the fluorinated resin particles.

The content of the inorganic particles in the charge transport layer is generally in the range of about 0.1 to about 30% by mass with respect to the entire amount of the charge transport layer, and preferably in the range of about 1 to about 20% by mass. When the content of the inorganic particles in the charge transport layer is less than about 0.1% by mass, the modifying effect due to dispersion of the inorganic particles may be insufficient. Meanwhile, when the content of the inorganic particles in the charge transport layer is greater than about 30% by mass, the residual potential of the charge transport layer due to repetitive use of the intermediate transfer member may increase. The average primary diameter of the inorganic particles is preferably in the range of about 0.005 to about 2.0 μm, and more preferably in the range of about 0.01 to about 1.0 μm.

In the invention, a dispersion liquid for forming the intermediate transfer member may contain at least one dispersion auxiliary agent in a small amount, which is effective in improving the dispersion stability of the dispersion liquid and preventing cohesion at the time that a coating layer is formed. Examples of the dispersion auxiliary agent include a fluorinated surfactant, fluorinated polymer, silicone polymer, and silicone oil. Among them, the dispersion auxiliary agent is effectively fluorinated polymer, particularly, fluorinated comb-type graft polymer. The fluorinated comb-type graft polymer is preferably resin obtained by graft-polymerizing perfluoroalkylethyl methacrylate, and at least one macro monomer of acrylic acid ester compounds, methacrylic acid ester compounds, and styrene compounds.

Undercoat Layer

As shown in FIGS. 2A and 2B, the intermediate transfer member in the invention may have an undercoat layer 122 between the substrate 110 and the charge generating layer 124. The undercoat layer serves as an electrical blocking layer, and improves wettability with respect to a charge generate layer formed on the undercoat layer.

The undercoat layer can be made of at least one of the following materials: polymer resin compounds such as acetal resin (e.g., polyvinyl butyral), polyvinyl alcohol resin, casein, polyamide resin, cellulose resin, gelatin, polyurethane resin, polyester resin, methacrylic resin, acrylic resin, polyvinyl chloride resin, polyvinyl acetate resin, vinyl chloride-vinyl acetate-maleic anhydride resin, silicone resin, silicone-alkyd resin, phenol-formaldehyde resin and melamine resin; and organic metal compound containing at least one of zirconium, titanium, aluminum, manganese, and silicon atoms. One of these compounds can be used alone, or two or more of them can be used as a mixture or a polycondensed product. Among them, the undercoat layer material is preferably an organic metal compound containing a zirconium or silicon atom because of excellent performance, such as low residual potential, and a decrease in change of potential due to the environment or repeated use. One of those organic metal compounds can be alone, or two or more of them can be used as a mixture. Moreover, at least one of the organic metal compounds may be used together with the above-described resin(s) as a mixture.

When the undercoat layer in the invention is excessively thick, this results in an excessively strong electrical barrier, and causes desensitization or an increase in potential. Therefore, when the undercoat layer having the aforementioned structure is formed, the thickness of the undercoat layer is preferably in the range of about 0.1 to about 3 μm.

Surface-Protecting Layer

In order to improve the abrasion resistance of the intermediate transfer belt, lengthen the life span thereof, and prevent chemical change of the charge transport layer, the intermediate transfer member may have a surface-protecting layer on the charge transport layer in the invention.

Examples of the surface-protecting layer include an insulating surface-protecting layer made of insulating resin, a resistance-controlled surface-protecting layer in which a resistance control agent such as metal oxide is dispersed, and a charge transport surface-protecting layer made of a polymer compound having charge-transporting properties.

Examples of the insulating resin used in the insulating surface-protecting layer include condensed resin such as polyamide resin, polyurethane resin, polyester resin, epoxy resin, polyketone resin, and polycarbonate resin; and vinyl polymer such as polyvinyl ketone resin, polystyrene resin, and polyacrylic amide resin.

The resistance control agent in the resistance-controlled surface-protecting layer may be particles made of at least one of carbon black, metal, and metal oxide. The average diameter of the particles is preferably about 100 nm or less.

The metal oxide may be subjected to surface treatment with at least one organic compound such as a silane coupling agent, a titanium coupling agent, or a zirconium coupling agent in order to improve the properties of the metal oxide such as dispersibility, if necessary.

The resistance-controlled surface-protecting layer preferably contains metal oxide particles having an average diameter of about 100 nm or less. In this case, the resistance-controlled surface-protecting layer has high transparency. Accordingly, thickening such a resistance-controlled surface-protecting layer does not result in a remarkable decrease in transmittance, and therefore hardly decreases sensitivity of the protecting layer. For these reasons, a thick resistance-controlled surface-protecting layer containing such metal oxide particles can be practically acceptable from the viewpoints of transmittance and sensitivity, and have improved mechanical strength. In addition, a resistance-controlled surface-protecting layer containing such metal oxide particles inherently has high abrasion resistance. Therefore, the thick resistance-controlled surface-protecting layer containing such metal oxide particles may further lengthen the life span of the intermediate transfer member.

The resistance-controlled surface-protecting layer is formed by dispersing the resistance control agent(s) (particles) in at least one binder resin such as acetal resin (e.g., polyvinyl butyral), polyvinyl alcohol resin, casein, polyamide resin, cellulose resin, gelatin, polyurethane resin, polyester resin, methacrylic resin, acrylic resin, polyvinyl chloride resin, polyvinyl acetate resin, vinyl chloride-vinyl acetate-maleic anhydride resin, silicone resin, silicone-alkyd resin, phenol resin, phenol-formaldehyde resin or melamine resin.

In order to appropriately control the resistance of the coating film, the amount of the resistance control agent(s) contained in the dispersion obtained by dispersing the resistance control agent(s) in the binder resin(s) is controlled. The content of the resistance control agent(s) contained in solid matter of the binder resin(s) is generally about 10 to about 60 percent by volume, and preferably about 20 to about 50 percent by volume.

The charge transport surface-protecting layer may contain at least one of polymer compounds each including, in the molecular thereof, at least one moiety having charge transport properties (hereinafter, the polymer compound may be called a charge transport polymer compound) and resin components in which at least one low-molecular charge transport agent molecules are dispersed in a strong coating agent such as a silicone hard coating agent to obtain a charge transport function.

The charge transport polymer compound(s) can be used together with at least one binder resin. Each of the at least one binder resin may be a known resin. Examples thereof include polyamide resin, polyvinylacetal resin, polyurethane resin, polyester resin, epoxy resin, polyketone resin, polycarbonate resin, polyvinyl ketone resin, polystyrene resin, polyacrylic amide resin, polyimde resin, and polyamideimide resin. These resins may be cross-linked, if necessary.

The surface-protecting layer is formed as follows. A coating liquid containing the components of the surface-protecting layer is prepared and coated on the charge transport layer and the resultant coating film is dried. A method of dispersing and compounding the resistance control agent or the charge transport polymer compound is conducted in the same manner as in the aforementioned method of forming a charge transport layer. The thickness of the surface-protecting layer is preferably in the range of about 0.1 to about 20 μm, and more preferably in the range of about 1 to about 10 μm. A method of coating a coating liquid for forming a surface-protecting layer may be a general coating method, such as a blade coating method, a wire bar coating method, a spray coating method, a dip coating method, a ring coating method, a bead coating method, an air knife coating method, or a curtain coating method.

The coating liquid for forming a surface-protecting layer may contain at least one solvent. Each of the at least one solvent may be a general organic solvent such as dioxane, tetrahydrofuran, methylene chloride, chloroform, chlorobenzene, toluene, or alcohol. It is preferable that each of the at least one solvent hardly dissolves the charge transport layer to which the coating liquid is applied.

Intermediate Layer

As shown in FIG. 2B, the intermediate transfer member that is used in the invention may have a structure with an intermediate layer 130 composed of one or more sub-layers between the substrate 110 and the photoconductive layer 120 serving as the surface layer of the intermediate transfer member. The intermediate layer 130 is preferably an elastic layer whose JIS-A hardness is in the range of about 40 to about 70 degrees. When the elastic layer of the intermediate transfer member has hardness within the range, the intermediate transfer member itself may have JIS-A hardness within the range of about 40 to about 70 degrees. In this case, the intermediate transfer member has improved adaptability and transferring properties with respect to a latent image-holding member and recording paper.

Further, when the intermediate transfer belt having elasticity is used, foreign matter adhering to the intermediate transfer belt or the latent image-holding member may be prevented from damaging the latent image-holding member in the primary transfer zone, and the surface of the intermediate transfer belt may adapt to the unevenness of the surface of recording paper, and thus the unevenness of the surface may be prevented from degrading quality of an image transferred to the recording paper in the secondary transfer zone.

The JIS-A hardness of the intermediate layer is more preferably in the range of about 45 to about 65 degrees.

In this case, the JIS-A hardness in the invention indicates hardness measured on the basis of JIS K 6253 (the edition published in 1997), the disclosure of which is incorporated by reference herein. In the invention, the JIS-A hardness of the intermediate layer can be measured with a specific apparatus (DUROMETER TYPE A manufactured by Shimadzu Corporation) on the basis of JIS K 6253 (1997). In the measurement, a sheet-shaped sample is used. These apply to measurement of the JIS-A hardness of the intermediate transfer member.

The thickness of the intermediate layer in the invention is preferably in the range of about 0.01 to about 0.5 mm, and more preferably in the range of about 0.05 to about 2 mm.

The material of the intermediate layer in the invention needs to have JIS-A hardness within the aforementioned range and volume resistivity similar to that of the substrate, and otherwise there is no limit to the material. The hardness and the volume resistivity of the intermediate layer can be adjusted by appropriately selecting at least one rubber material and the contents of at least one of conductive agents and low molecular weight components. Specifically, the intermediate layer can be a layer in which at least one conductive agent is dispersed in at least one rubber material such as nitrile rubber, ethylene-propylene rubber, chloroprene rubber, isoprene rubber, styrene rubber, butadiene rubber, butyl rubber, chlorosulfonated polyethylene, urethane rubber, epichlorohydrin rubber, acrylic rubber, silicone rubber or fluorinated rubber.

Each of the at least one conductive agent can be a conductive agent for providing electronic conductivity or a conductive agent for providing ionic conductivity The conductive agent for providing electronic conductivity may be carbon black, graphite, metal or an alloy such as aluminum, nickel or a copper alloy, or metal oxide such as tin oxide, zinc oxide, or composite oxide (e.g., tin oxide-indium oxide or tin oxide-antimony oxide), or potassium titanate. The conductive agent for providing ionic conductivity may be sulfonate, an ammonia salt, or a cationic, anionic, or nonionic surfactant.

As aforementioned, one of those rubber materials can be used alone, or two or more of them can be used as a mixture. Also, one of these conductive agents may be used alone, or two or more of them can be used as a mixture.

Each of the rubber material is preferably a liquid rubber material. Use of a liquid rubber material can provide good wettability with respect to the charge generating layer formed on the intermediate layer. Therefore, it is unnecessary to provide an adhesive layer between the intermediate layer and the charge generating layer. As a result, it is possible to simplify the structure of the intermediate transfer member, which is very advantageous in manufacturing the intermediate transfer belt and which is also advantageous from the viewpoint of cost.

Generally, an intermediate layer whose raw materials include a liquid rubber material is formed as follows. At least one conductive agent such as carbon black is dispersed in at least one liquid rubber material to form a dispersion. If necessary, the dispersion is diluted with at least one appropriate solvent to adjust the viscosity of the dispersion. The dispersion itself or the diluted dispersion is coated on a substrate, and the resultant coating is sintered and vulcanized.

An intermediate layer whose raw materials include at least one rubber material other than a liquid rubber material is formed as follows.

A mixture obtained by adding at least one conductive agent such as carbon black to at least one raw rubber material is kneaded with a kneader such as a BANBURY mixer. The kneaded matter is subjected to press working to form a rubber sheet. The rubber sheet is wound around a substrate and vulcanized to bond the rubber sheet with the substrate. Thus, an intermediate layer is formed.

The surface micro hardness of the intermediate transfer belt in the invention that has the intermediate layer is preferably in the range of about 0.1 to about 3, and more preferably in the range of about 0.2 to about 2.5.

Unlike Vickers hardness, which is widely used as the hardness of a metallic material, the surface micro hardness is not obtained by a method of obtaining the length of the diagonal line of a depression. The surface micro hardness can be obtained by a method of measuring the degree to which an indenter pressed against a sample dents the sample rather. Given the test load is P (mN), and the depth of the dent made in the sample by the indenter is D (μm), the surface micro hardness DH is defined by the following Equation (2).

$$DH=\alpha P/D^2 \qquad \text{Equation (2)}$$

In the equation, α indicates a constant according to the shape of the indenter, and, when the indenter used is a triangular pyramid indenter, is 3.8584.

The surface micro hardness is obtained from the load in the course of pressing the indenter against the sample and the depth of a dent generated by the pressing, and indicates the strength characteristics of the sample that include not only plastic deformation of the sample but also elastic deformation of the sample. The measured area is micro and is close to a toner particle diameter, making it possible to measure hardness under conditions closer to those under which the intermediate transfer belt is actually used in an image forming apparatus. In the primary transfer zone, a primary transfer roll is offset (shifted) from a position that is opposite to a latent image-holding member to a position that is located on the downstream side of that position in the moving direction of an intermediate transfer belt by a predetermined distance, so as to widen the area of a nip between the latent image-holding member and the intermediate transfer belt. Thereby, a part of the intermediate transfer belt is wrapped around the latent image-holding member. When the surface micro hardness of the surface of the intermediate transfer belt used in the above manner is in the range of about 0.1 to about 3, particularly in the range of about 0.2 to about 2.5, a portion of the surface (transfer surface) of the intermediate transfer belt which portion is being brought into contact with the latent image-holding member may deform and adapt to the surface of the latent image-holding member. As a result, the adhesion between the latent image-holding member and the intermediate transfer belt is improved. Moreover, even when foreign matter exists on, for example, the latent image-holding member, contact between the latent image-holding member and the intermediate transfer belt may be prevented from damaging the surface of the latent image-holding member. In the secondary transfer zone, a portion of the surface of the intermediate transfer belt against which portion a bias roller is pressing deforms by the pressing force of the bias roller. Thereby, the pressing force is distributed and is not concentrated on the toner disposed on the intermediate transfer belt. For this reason, cohesion of the toner particles does not occur, and image quality defects, such as hollow characters having a missing portion in a line image portion, does not occur.

The surface micro hardness of the transfer surface of the intermediate transfer belt is obtained by the following method. A square small piece having an edge length of about 5 mm is cut from a sheet of the material of the transfer surface portion of the intermediate transfer belt. Thereafter, the small piece is fixed on a glass plate by an instantaneous adhesive agent. The surface micro hardness of the surface of the piece is measured with an ultra micro hardness tester (DUH-201S manufactured by Shimadzu Corporation). The measurement conditions are as follows.

Measurement circumference: temperature of 23° C. and humidity of 55% RH

Indenter used: triangular pyramid indenter

Test mode: 3 (soft material test)

Test load: 0.70 gf

Load speed: 0.0145 gf/sec

Holding time: 5 sec

The surface layer serving as the photoconductive layer of the intermediate transfer belt used in the invention is dielectric, when the surface layer is not being irradiated with light. Specifically, the volume resistivity (dark resistance) of the surface layer that is not being irradiated with light is preferably $1\times10^{13}\Omega$ or more, and more preferably $1\times10^{14}\Omega$ or more. Irradiation of the surface layer with light changes the resistivity of the surface layer, and the surface layer that is being irradiated with light is electrically conductive.

Figure 3A:
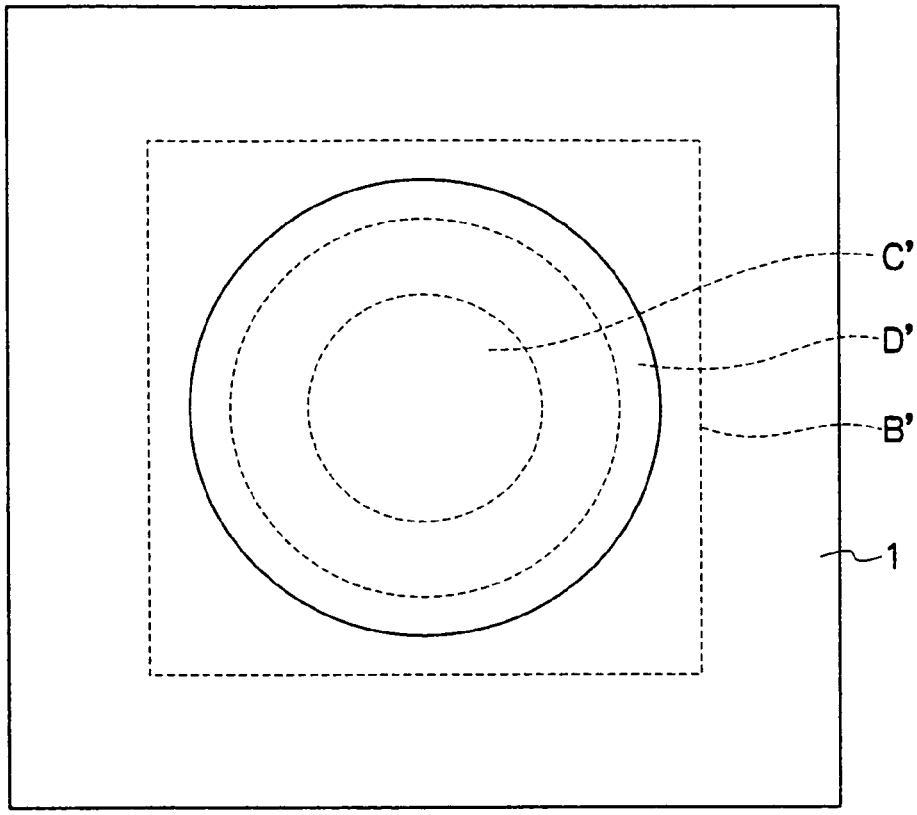
FIG. 3A is a plan view schematically illustrating an example of an electrode having a circular plan shape.

The volume resistivity of the intermediate transfer belt in the invention can be measured with a cylindrical electrode (for example, HR PROBE OF HIRESTA IP manufactured by Dia instrument Co., Ltd.) according to JIS K 6911, the disclosure of which is incorporated by reference herein. Hereinafter, a method of measuring volume resistivity will be described with reference to FIGS. 3A and 3B. FIG. 3A is a plan view schematically illustrating an example of the cylindrical electrode, and FIG. 3B is a cross-sectional view schematically illustrating the example of a cylindrical electrode.

Figure 3B:
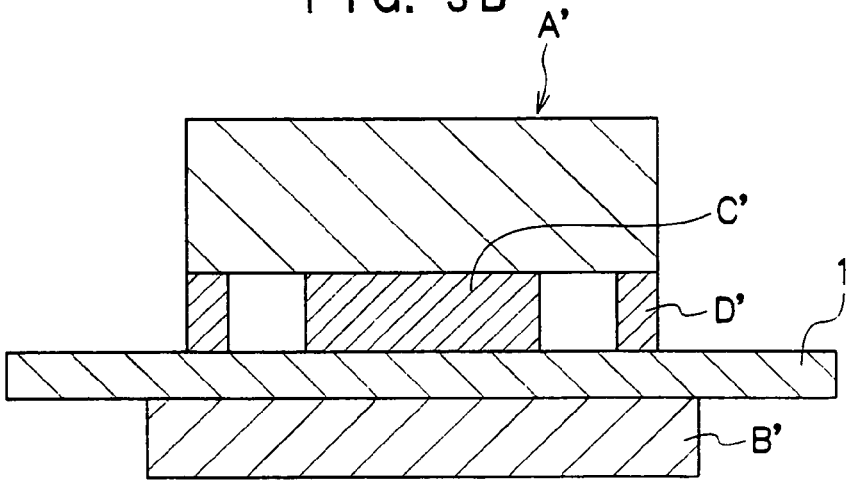
FIG. 3B is a cross-sectional view schematically illustrating the electrode of FIG. 3A.

The cylindrical electrode shown in FIGS. 3A and 3B includes a first voltage-applying electrode A' and a square plate-like second voltage-applying electrode B'. The first voltage-applying electrode A' has a solid cylindrical portion and a support portion that supports the solid cylindrical portion. The support portion has a solid cylindrical portion C', and a hollow cylindrical portion D'. The hollow cylindrical portion D' has an inner diameter larger than the outer diameter of the solid cylindrical portion C'. Moreover, the hollow cylindrical portion D' surrounds the solid cylindrical portion C', with a gap disposed therebetween. An intermediate transfer belt 1 is interposed between the solid cylindrical portion C' and the hollow cylindrical portion D' of the first voltage-applying electrode A', and the second voltage-applying electrode B'. A voltage V (V) is applied between the solid cylindrical portion C' of the first voltage-applying electrode A' and the second voltage-applying electrode B'. A current I (A) flowing at this time is measured, and the volume resistivity ρv (Ωcm) of the intermediate transfer belt 1 is calculated by assigning the voltage V and the current I to the following Equation (3). In Equation (3), t indicates the thickness of the intermediate transfer belt 1.

$$\rho v=19.6\times(V/I)\times t \qquad \text{Equation (3)}$$

As in the volume resistivity, the surface resistivity (dark resistance) of the intermediate transfer belt used in the invention is preferably $1\times10^{13}\Omega/\square$ or more, and more preferably $1\times10^{14}\Omega/\square$ or more from the viewpoint of prevention of blur.

The surface resistivity of the intermediate transfer belt in the invention can also be measured with a cylindrical electrode (for example, HR PROBE OF HIRESTA IP manufactured by Dia instrument Co., Ltd.) according to JIS K 6911. The cylindrical electrode may be the same as that shown in FIG. 3 except that reference 3 indicates a square plate-like insulator in place of the second voltage-applying electrode.

The surface resistivity is measured as follows. When an intermediate transfer belt 1 is being interposed between the solid cylindrical portion C' and the hollow cylindrical portion D' of the first voltage-applying electrode A', and the insulator B', a voltage V (V) is applied between the solid cylindrical portion C' and the hollow cylindrical portion D' of the first voltage-applying electrode A'. A current I (A) flowing at this time is measured, and the surface resistivity ρs (Ω/□) of the intermediate transfer belt 1 is calculated by assigning the voltage V and the current I to the following Equation (4).

In order to measure the surface resistivity of the outer (or inner) circumferential surface of the intermediate transfer belt, the intermediate transfer belt 1 is disposed such that the outer (or inner) circumferential surface of the intermediate transfer belt is brought into contact with the solid cylindrical portion C' and the hollow cylindrical portion D'.

$$\rho s=\pi\times(D+d)/(D-d)\times(V/I). \qquad \text{Equation (4)}$$

In Equation (4), d (mm) indicates the outer diameter of the solid cylindrical portion C', and D (mm) indicates the inner diameter of the hollow cylindrical portion D'.

The method of measuring volume resistivity of an intermediate transfer belt and the method of measuring surface resistivity of an intermediate transfer belt can be applied to a method of measuring volume resistivity of a substrate and that of measuring surface resistivity of a substrate.

The total thickness of the intermediate transfer belt in the invention is preferably in the range of about 0.03 to about 1.0 mm, more preferably in the range of about 0.05 to about 0.8 mm, and most preferably in the range of about 0.1 to about 0.5 mm.

When the total thickness of the intermediate transfer belt is less than about 0.03 mm, the degrees of elongation and contraction (variations) of the belt due to disturbance (load variation) at the time that the belt is being driven become larger. As a result, good image quality may not be stably obtained. Meanwhile, when the total thickness of the intermediate transfer belt is greater than about 1.0 mm, the degree of deformation of the bending portion, such as a portion in the vicinity of a driving roll, of the outer surface of the belt becomes larger, and thus good image quality may not be obtained. Further, both the degree of deformation of the outer surface of the belt and that of the inner surface of the belt become larger, and thus the belt may break due to local repetitive stresses.

The ratio of the thickness of the surface layer (photoconductive layer) to the total thickness of the intermediate transfer belt is preferably in the range of about 10 to about 80%, and more preferably in the range of about 20 to about 60%.

EXAMPLES

Hereinafter, the invention will be described in more detail while referring to Examples. However, the invention is not limited to the Examples. In the following, "parts" means parts by mass, unless otherwise indicated.

<Methods of Measuring Various Characteristics>

First, methods of measuring physical properties of each of carriers used in Examples and Comparative Examples will be described.

Method of Measuring Average Degree of Circularity of Carrier 0.03 g of a carrier is dispersed in an aqueous solution containing 25% by mass of ethylene glycol, and the resultant dispersion liquid is used to measure an average degree of circularity. In the measurement, FPIA3000 manufactured by Sysmex Corporation is used as a measuring apparatus. The measurement is performed in an LPF measurement mode. Particles whose diameters are less than 10 μm and those whose diameters are greater than 50 μm are excluded from the measurement. The remaining is subjected to analysis, and an average degree of circularity of the remaining is obtained.

Method of Measuring Young's Modulus of Substrate of Intermediate Transfer Belt

A piece of the substrate of an intermediate transfer belt and having a rectangular surface with dimensions of 25 mm×250 mm is used as a measurement sample, and the Young's modulus of the sample is measured at a stretching speed of 20 mm/min on the basis of JIS K 6251:93.

Measurement of Covering Rate of Coating Resin of Carrier

The covering rate of cores is obtained by measuring the area of at least one peak derived from iron existing on the surfaces of the cores (uncovered) and the area of at least one peak derived from iron existing on the surfaces of carrier particles (covered) with an XPS (JPS80 manufactured by JEOL, Ltd.) device, and assigning the measured areas to the following equation.

$$\text{Covering rate (\%)}=\{1-(\text{peak area due to iron of carrier})/(\text{peak area due to iron of core})\}\times 100$$

Measurement of Amount of Resin Coating of Carrier

Two grams of a carrier and 20 ml of toluene are put in a beaker having a volume of 100 ml, and the carrier particles and toluene are processed by an ultrasonic cleaner (UT-105 manufactured by SHARP CORPORATION) at an output of 100% for ten minutes. Thereafter, while a magnet is placed on the outer bottom surface of the beaker to dispose the processed particles in the lower portion of the beaker, a supernatant is removed. These processes are repeatedly performed three times, and the resultant bare cores are then dried. Subsequently, the total weight of the cores is measured, and the weight is subtracted from the weight of the carrier particles (two grams) to obtain the amount of the coating layer. The amount is divided by the weight of the cores, and the quotient is multiplied by 100. The product is used as the coating content.

Method of Measuring Surface Roughness of Ferrite Core

The surface roughness Ra (arithmetic average roughness) and the surface roughness Sm (mean spacing between protrusions) are measured. In the measurement, the surfaces of 50 carriers magnified by an ultra deep color 3D shape measuring microscope (VK-9500 manufactured by Keyence Corporation) to 3,000 times their actual size are observed.

In the measurement of the surface roughness Ra, the reference length is 10 μm, and the cut off value is 0.08 mm. In the measurement of the surface roughness Sm, the reference length is 10 μm, and the cut off value is 0.08 mm.

Example 1

Preparation of Ferrite Particle C1

Seventy-three parts of $Fe_2O_3$, 23 parts of $MnO_2$, and 4 parts of $Mg(OH)_2$ are mixed. The resultant mixture is further mixed and pulverized with a wet-type ball mill for 25 hours, and the resultant particles are dried with a spray drier. Thereafter, the resultant particles are subjected to a first preliminary sintering process that is conducted with a rotary kiln at 800° C. for seven hours. As a result, a preliminarily sintered matter 1 is obtained.

The preliminarily sintered matter 1 is pulverized with a wet-type ball mill for seven hours to obtain particles having an average diameter of 1.8 μm. The resultant particles are dried with a spray drier, and then subjected to a second preliminary sintering process that is performed by a rotary kiln at 900° C. for six hours. As a result, a preliminarily sintered matter 2 is obtained.

The obtained preliminarily sintered material 2 is pulverized with a wet-type ball mill for five hours to obtain particles having an average diameter of 5.2 μm. The particles are dried with a spray drier, and then subjected to a main sintering process that is performed with an electric furnace at 900° C. for ten hours.

After the main sintering process, the resultant matter is pulverized and the resultant particles are classified to prepare Mn—Mg ferrite particles C1 (core particles) having an average diameter of 36.2 μm. The ferrite particles C1 have surface roughness Sm of 1.5 μm, and surface roughness Ra of 0.5 μm.

| Preparation of carrier 1 | |
|---|---|
| Mn—Mg ferrite particles C1 | 100 parts |
| Solution 1 for forming coating layer | |
| Toluene | 100 parts |
| Styrene-methyl metacrylate (St-MMA) copolymer (mass ratio of former monomer to latter monomer of 60:40, and weight-average molecular weight of 80,000) | 4.5 parts |
| Carbon black (REGAL 330 manufactured by Cabot Corporation) | 0.5 parts |

The components except the core particles C1 are stirred with a stirrer for sixty minutes to prepare a solution 1 for forming a coating layer. The solution 1 and the ferrite particles are put in a fluidized bed (MP-01SFP manufactured by POWREX CORPORATION), and the fluidized bed is driven at a rotor revolution rate of 1,000 rpm at a gas volume of 1.2 $m^3$/min at a solution protruding speed of 10 g/min at 70° C. Thus, a coating is formed on each of the ferrite particles. The resultant coated particles are sieved with a mesh having a pore size of 75 μm, and thus carrier 1 is manufactured.

The degree of circularity of the carrier 1 is 0.989, and the coating content of the resin coating is 4.6% by mass with respect to the mass of the ferrite particles C1.

Preparation of Developer 1M

Hundred parts of the carrier 1, and 8 parts of a magenta toner for DOCU CENTRE COLOR F 450 image forming apparatus are mixed with a V blender, and the resultant mixture is sieved. In this way, a developer 1M is manufactured.

Preparation of Developer 1C

Hundred parts of the carrier 1, and 8 parts of a cyan toner for DOCU CENTRE COLOR F 450 image forming apparatus are mixed with a V blender, and the resultant mixture is sieved. In this way, developer 1C is manufactured.

Intermediate Transfer Belt 1

A dispersion in which carbon black is dispersed in polyimide varnish (U VARNISH-S manufactured by UBE INDUSTRIES, Ltd.) is thermally cured to manufacture a belt substrate having a thickness of 80 μm. The Young's modulus of the substrate is 6,000 MPa. The substrate is sprayed with an FEP rubber paint and the resultant is heated so as to form a coating layer having a thickness of 50 μm. In this manner, an intermediate transfer belt 1 is manufactured.

Evaluation (1) Measurement of Number of Carrier Pieces Sticking into Photoreceptor An image forming apparatus (DOCU CENTRE COLOR F450 manufactured by Fuji Xerox Co., Ltd.) is remoulded as follows. Its original intermediate transfer belt is replaced with the intermediate transfer belt 1. The primary transfer nip pressure is set to 11 gf/cm, the process speed is set to 165 mm/sec, and the primary transfer current value is set to 20 μA.

The developer 1M is supplied to one of the developing units of the image forming apparatus and the developing roll is idled in the developing unit at 20° C. at 50% RH for twenty hours, and an image with a solid patch having sizes of 5 cm×2 cm is printed on one thousand sheets of paper. Thereafter, the photoreceptor is detached from the image forming apparatus, and the portion of the photoreceptor which portion has been used to print the solid patch and that is disposed along the entire circumference of the photoreceptor is observed with a magnifier, and the number of carrier pieces sticking into the photoreceptor is counted with visual observation, and found to be two.

The number of the carrier pieces sticking into the photoreceptor being less than 5 is excellent. The number being in the range of 5 to 10 is practically acceptable. The number being greater than 10 is not practically acceptable.

(2) Evaluation of Transfer Misalignment

After the solid image has been printed on one thousand sheets of paper to evaluate the number of carrier pieces sticking into the photoreceptor, the developer 1C is supplied to another one of the developing units. A halftone patch having sizes of 5 cm×2 cm and a density Cin of 30% is printed using the two developers 1M and 1C on one thousand sheets of paper so that two colored images are overlapped with each other. The resultant composite image is magnified by a magnifier to 50 times its actual size, and the displacement amount (misalignment width) between the colored images in the magnified composite image is measured. When the misalignment width of these images is equal to or greater than 125 μm, image quality of such images is not practically acceptable.

(3) Evaluation of Image Density

The image density of the 1000th solid image obtained in the measurement of the number of carrier pieces sticking into the photoreceptor, in which the solid image is printed on one thousand sheets of paper, is measured with a reflection densitometer (X-RITE 404 manufactured by X-Rite, Inc). Quality of images having an image density of less than 1.4 is not practically acceptable.

Examples 2 to 5

Ferrite particles C2 to C5 are manufactured in the same manner as the ferrite particles C1 used in Example 1, except that the conditions of the first preliminary sintering process, the second preliminary sintering process, and the main sintering process are changed to those shown in Table 1 so as to change at least one of surface roughness Sm and surface roughness Ra.

Developers of Examples 2 to 5 are manufactured and evaluation using each of these developers is conducted in the same manner as in Example 1, except that the ferrite particles C1 are replaced with the respective ferrite particles C2 to C5.

Examples 6 and 7

Carrier particles for Examples 6 and 7 are manufactured in the same manner as the ferrite particles C1 used in Example 1, except that the amount of St-MMA is changed to 3.1 parts (Example 6) or 9.6 parts (Example 7) in forming the solution 1 for forming a coating layer that is used to manufacture the carrier particles. The carrier particles for Example 6 have a degree of circularity of 0.989 and a coating content of the coating resin of 3.2% by mass with respect to the mass of the ferrite particles C1. The carrier particles for Example 7 have a degree of circularity of 0.989 and a coating content of the coating resin of 9.7% by mass with respect to the mass of the ferrite particles C1.

Developers of Examples 6 and 7 are manufactured and evaluation using each of these developers is conducted in the same manner as in Example 1, except that the ferrite particles C1 are replaced with the ferrite particles for Example 6 and those for Example 7, respectively.

Example 8

Ferrite particles C6 are manufactured in the same manner as the ferrite particles C1 used in Example 1, except that the conditions of the first preliminary sintering process, the second preliminary sintering process, and the main sintering process in preparing the ferrite particles are changed to those shown in Table 1 so as to change a degree of circularity.

A developer of Example 8 is manufactured and evaluation using this developer is conducted in the same manner as in Example 1, except that the ferrite particles C1 are replaced with the ferrite particles C6.

Example 9

An intermediate transfer belt is prepared in the same manner as the intermediate transfer belt 1 used in Example 1, except that the polyimide varnish (U VARNISH-S manufactured by UBE INDUSTRIES, Ltd.) is replaced with polyimide varnish (U VARNISH-A manufactured by UBE INDUSTRIES, Ltd.), and except that the intermediate transfer belt has Young's modulus of 3,500 MPa.

Evaluation is conducted in the same manner as in Example 1, except that the intermediate transfer belt used in Example 1 is replaced with the above-manufactured intermediate transfer belt.

Examples 10 to 13

A developer is manufactured and evaluation using this developer is conducted in the same manner as in Example 1, except that the primary transfer nip pressure, the process speed, and the primary transfer current value are changed to those shown in Table 2.

Examples 14 and 15

Carrier particles for Examples 14 and 15 are manufactured and developers of Examples 14 and 15 are manufactured and evaluation using each of these developers is conducted in the same manner as in Example 1, except that the coating resin used to prepare the carrier particles is changed to dimethyl-silicone resin (SR2411 manufactured by Dow Corning Toray Silicone Co., Ltd.), and except that the coating content of the coating resin is changed to that shown in Table 2, and except that the dimethyl silicone coated is hardened at 150° C. for one hour, and except that the carrier particles C1 are replaced with the resultant carrier particles for Example 14 and those for Example 15, respectively.

Comparative Example 1

Preparation of Ferrite Particle C7

Seventy-three parts of $Fe_2O_3$, 23 parts of $MnO_2$, and 4 parts of $Mg(OH)_2$ are mixed. The resultant mixture is further mixed and pulverized with a wet-type ball mill for 10 hours, and the resultant particles are dried with a spray drier. Thereafter, the resultant particles are subjected to a first preliminary sintering process that is conducted with a rotary kiln at 900° C. for eight hours. The resultant preliminarily sintered matter 1 is pulverized with a wet-type ball mill for seven hours to obtain particles having an average diameter of 2.9 μm. The resultant particles are dried with a spray drier, and then subjected to a main sintering process that is performed with an electric furnace at 1250° C. for eight hours.

After the main sintering process, the resultant matter is pulverized and the resultant particles are classified to prepare Mn—Mg ferrite particles C7 (core particles) having an average diameter of 37.1 μm. The ferrite particles C7 have surface roughness Sm of 2.2 μm, and surface roughness Ra of 0.07 μm.

A developer of Comparative Example 1 is manufactured and evaluation using this developer is conducted in the same manner as in Example 1, except that the ferrite particles C1 are replaced with the ferrite particles C7. As a result, it has been confirmed that the number of carrier pieces sticking into the photoreceptor is 68.

Comparative Examples 2 and 3

Ferrite particles for Comparative Examples 2 and 3 and developers of Comparative Examples 2 and 3 are manufactured and evaluation using each of these developers is conducted as in Example 1, except that the conditions of the first preliminary sintering process, the second preliminary sintering process, and the main sintering process are changed to those shown in Table 1 in preparing the ferrite particles so as to change at least one of surface roughness Sm and surface roughness Ra, and except that the ferrite particles C1 used to prepare the carrier particles 1 are replaced with the above-manufactured ferrite particles for Comparative Example 2 and those for Comparative Example 3, respectively.

Comparative Examples 4 and 5

Ferrite particles for Comparative Examples 4 and 5 and developers of Comparative Examples 4 and 5 are manufactured and evaluation using each of these developers is conducted as in Example 1, except that the amount of St-MMA contained in the solution 1 for forming a coating layer which solution is used to prepare the carrier particles is changed to 2.0 parts (Comparative Example 4) or 11.1 parts (Comparative Example 5), and except that the coating content of the coating resin of the carrier particles for Comparative Example 4 is 2.1% by mass with respect to the mass of the ferrite particles C1, and except that the coating content of the coating resin on the carrier particles for Comparative Example 5 is 11.2% by mass with respect to the mass of the ferrite particles C1.

Comparative Example 6

Ferrite particles for Comparative Example 6 and a developer of Comparative Example 6 are manufactured and evaluation using this developer is conducted as in Example 1, except that the conditions of the first preliminary sintering process, the second preliminary sintering process, and the main sintering process are changed to those shown in Table 1 in preparing the ferrite particles, and except that the ferrite particles C1 used to the carrier particles 1 are replaced with the above-manufactured ferrite particles.

Comparative Example 7

A developer of Comparative Example 7 is manufactured and evaluation using this developer is conducted as in Example 14, except that the ferrite particles C1 are replaced with the ferrite particles C9.

Comparative Example 8

A developer of Comparative Example 8 is manufactured and evaluation using this developer is conducted as in Example 14, except that the ferrite particles C1 are replaced with the ferrite particles C8.

TABLE 1

| Ferrite | First preliminary sintering process | | Second preliminary sintering process | | Main sintering process | | Particle diameter | Sm | Ra | Degree of circu- |
|---|---|---|---|---|---|---|---|---|---|---|
| particle | *1 | *2 | *1 | *2 | *1 | *2 | (μm) | (μm) | (μm) | larity |
| C1 | ball mill, and 25 hours | rotary kiln, 800° C., 7 and hours | ball mill, and 7 hours | rotary kiln, 900° C., and 6 hours | ball mill, and 5 hours | electric furnace, 900° C., and 10 hours | 36.2 | 1.5 | 0.5 | 0.989 |
| C2 | ball mill and 25 hours | rotary kiln, 800° C., and 10 hours | none | | ball mill, and 10 hours | electric furnace, 900° C., and 12 hours | 38.4 | 2.0 | 0.5 | 0.985 |
| C3 | ball mill and 25 hours | rotary kiln, 800° C., and 7 hours | ball mill, and 7 hours | rotary kiln, 900° C., and 6 hours | ball mill, and 5 hours | electric furnace, 900° C., and 17 hours | 40.1 | 1.5 | 0.1 | 0.981 |
| C4 | ball mill and 25 hours | rotary kiln, 800° C., and 7 hours | ball mill, and 7 hours | rotary kiln, 900° C., and 6 hours | ball mill, and 5 hours | electric furnace, 1000° C., and 8 hours | 38.1 | 0.5 | 0.1 | 0.987 |

TABLE 1-continued

| Ferrite particle | First preliminary sintering process *1 | First preliminary sintering process *2 | Second preliminary sintering process *1 | Second preliminary sintering process *2 | Main sintering process *1 | Main sintering process *2 | Particle diameter (μm) | Sm (μm) | Ra (μm) | Degree of circularity |
|---|---|---|---|---|---|---|---|---|---|---|
| C5 | ball mill and 25 hours | rotary kiln, 800° C., and 7 hours | ball mill, and 7 hours | rotary kiln, 800° C., and 6 hours | ball mill, and 5 hours | electric furnace, 850° C., and 13 hours | 35.9 | 1.8 | 0.8 | 0.989 |
| C6 | ball mill and 20 hours | rotary kiln, 800° C., and 7 hours | ball mill, and 2 hours | rotary kiln, 900° C., and 6 hours | ball mill, and 5 hours | electric furnace, 900° C., and 10 hours | 37.4 | 1.5 | 0.5 | 0.972 |
| C7 | ball mill and 10 hours | rotary kiln, 900° C., and 8 hours | none | | ball mill, and 7 hours | electric furnace, 1250° C., and 8 hours | 37.1 | 2.2 | 0.07 | 0.965 |
| C8 | ball mill and 10 hours | rotary kiln, 900° C., and 10 hours | none | | ball mill, and 7 hours | electric furnace, 900° C., and 18 hours | 39.8 | 2.2 | 0.5 | 0.989 |
| C9 | ball mill and 25 hours | rotary kiln, 800° C., and 7 hours | ball mill, and 7 hours | rotary kiln, 900° C., and 6 hours | ball mill, and 5 hours | electric furnace, 1200° C., and 8 hours | 35.9 | 1.5 | 0.07 | 0.980 |
| C10 | ball mill and 25 hours | rotary kiln, 800° C., and 7 hours | none | | ball mill, and 5 hours | electric furnace, 900° C., and 10 hours | 38.7 | 1.5 | 0.5 | 0.968 |

Note
*1 Type of device and time of pulverization in wet manner
*2 Type of device, and temperature and time of sintering

TABLE 2

| | Carrier: Core: Particle diameter (μm) | Carrier: Core: Surface roughness (Sm) (μm) | Carrier: Core: Surface roughness (Ra) (μm) | Carrier: Resin coating layer: Material | Carrier: Resin coating layer: Coating content (mass %) | Carrier: Degree of circularity | Intermediate transfer member: Substrate: Young's modulus (Kg/cm$^2$) | Primary transfer: Nip pressure (gf/cm) | Primary transfer: Current value (T) (μA) | Primary transfer: Processing speed (P) (mm/sec) | (T)/(P) |
|---|---|---|---|---|---|---|---|---|---|---|---|
| Ex. 1 | 36.2 | 1.5 | 0.5 | St-MMA | 4.6 | 0.989 | 6000 | 11 | 20 | 165 | 0.12 |
| Ex. 2 | 38.4 | 2.0 | 0.5 | St-MMA | 4.5 | 0.985 | 6000 | 11 | 20 | 165 | 0.12 |
| Ex. 3 | 40.1 | 1.5 | 0.1 | St-MMA | 4.3 | 0.981 | 6000 | 11 | 20 | 165 | 0.12 |
| Ex. 4 | 38.1 | 0.5 | 0.1 | St-MMA | 4.5 | 0.987 | 6000 | 11 | 20 | 165 | 0.12 |
| Ex. 5 | 35.9 | 1.8 | 0.8 | St-MMA | 4.7 | 0.989 | 6000 | 11 | 20 | 165 | 0.12 |
| Ex. 6 | 36.2 | 1.5 | 0.5 | St-MMA | 3.2 | 0.989 | 6000 | 11 | 20 | 165 | 0.12 |
| Ex. 7 | 36.2 | 1.5 | 0.5 | St-MMA | 9.7 | 0.989 | 6000 | 11 | 20 | 165 | 0.12 |
| Ex. 8 | 37.4 | 1.5 | 0.5 | St-MMA | 4.1 | 0.972 | 6000 | 11 | 20 | 165 | 0.12 |
| Ex. 9 | 36.2 | 1.5 | 0.5 | St-MMA | 4.7 | 0.989 | 3500 | 11 | 20 | 165 | 0.12 |
| Ex. 10 | 36.2 | 1.5 | 0.5 | St-MMA | 4.7 | 0.989 | 6000 | 8 | 20 | 165 | 0.12 |
| Ex. 11 | 36.2 | 1.5 | 0.5 | St-MMA | 4.7 | 0.989 | 6000 | 20 | 20 | 165 | 0.12 |
| Ex. 12 | 36.2 | 1.5 | 0.5 | St-MMA | 4.7 | 0.989 | 6000 | 11 | 18 | 220 | 0.08 |
| Ex. 13 | 36.2 | 1.5 | 0.5 | St-MMA | 4.7 | 0.989 | 6000 | 11 | 19 | 104 | 0.18 |
| Ex. 14 | 36.2 | 1.5 | 0.5 | Silicone | 4.1 | 0.989 | 6000 | 11 | 20 | 165 | 0.12 |
| Ex. 15 | 36.2 | 1.5 | 0.5 | Silicone | 4.2 | 0.989 | 6000 | 11 | 20 | 165 | 0.12 |
| Comp. Ex. 1 | 37.1 | 2.2 | 0.07 | St-MMA | 4.6 | 0.965 | 6000 | 11 | 20 | 165 | 0.12 |
| Comp. Ex. 2 | 39.8 | 2.2 | 0.5 | St-MMA | 4.5 | 0.989 | 6000 | 11 | 20 | 165 | 0.12 |
| Comp. Ex. 3 | 35.9 | 1.5 | 0.07 | St-MMA | 4.6 | 0.980 | 6000 | 11 | 20 | 165 | 0.12 |
| Comp. Ex. 4 | 36.2 | 1.5 | 0.5 | St-MMA | 2.1 | 0.989 | 6000 | 11 | 20 | 165 | 0.12 |
| Comp. Ex. 5 | 36.2 | 1.5 | 0.5 | St-MMA | 11.2 | 0.989 | 6000 | 11 | 20 | 165 | 0.12 |
| Comp. Ex. 6 | 38.7 | 1.5 | 0.5 | St-MMA | 3.9 | 0.968 | 6000 | 11 | 20 | 165 | 0.12 |
| Comp. Ex. 7 | 35.9 | 1.5 | 0.07 | Silicone | 4.5 | 0.980 | 6000 | 11 | 20 | 165 | 0.12 |
| Comp. Ex. 8 | 39.8 | 2.2 | 0.5 | Silicone | 4.6 | 0.989 | 6000 | 11 | 20 | 165 | 0.12 |

TABLE 3

| | Evaluation result: Number of carrier pieces sticking to photoreceptor | Evaluation result: Transfer misalignment (μm) | Evaluation result: Image density |
|---|---|---|---|
| Example 1 | 2 | 40 | 1.53 |
| Example 2 | 8 | 50 | 1.51 |
| Example 3 | 1 | 50 | 1.50 |
| Example 4 | 4 | 40 | 1.49 |

TABLE 3-continued

| | Evaluation result: Number of carrier pieces sticking to photoreceptor | Evaluation result: Transfer misalignment (μm) | Evaluation result: Image density |
|---|---|---|---|
| Example 5 | 10 | 60 | 1.52 |
| Example 6 | 4 | 40 | 1.51 |
| Example 7 | 1 | 50 | 1.50 |
| Example 8 | 7 | 40 | 1.49 |

TABLE 3-continued

| | Evaluation result | | |
|---|---|---|---|
| | Number of carrier pieces sticking to photoreceptor | Transfer misalignment (μm) | Image density |
| Example 9 | 0 | 90 | 1.53 |
| Example 10 | 0 | 80 | 1.51 |
| Example 11 | 6 | 40 | 1.58 |
| Example 12 | 2 | 70 | 1.41 |
| Example 13 | 5 | 20 | 1.57 |
| Example 14 | 3 | 40 | 1.52 |
| Example 15 | 4 | 30 | 1.53 |
| Comparative Example 1 | 68 | 40 | 1.51 |
| Comparative Example 2 | 27 | 60 | 1.53 |
| Comparative Example 3 | 16 | 60 | 1.50 |
| Comparative Example 4 | 21 | 50 | 1.51 |
| Comparative Example 5 | 12 | 40 | 1.40 |
| Comparative Example 6 | 17 | 40 | 1.51 |
| Comparative Example 7 | 20 | 50 | 1.52 |
| Comparative Example 8 | 34 | 40 | 1.50 |

Example 100

Preparation of Core Particles C100

Forty parts of phenol and 60 parts of formalin, 400 parts of magnetite (having an average particle diameter of 0.20 μm and a spherical shape, and treated with 1% by weight of KBM403), 12 parts of ammonia water, 60 parts of deionized water are mixed. While the resultant mixture is stirred, the mixture is gradually heated to 85° C. and kept at that time to conduct reaction and curing for four hours. The resultant reaction system is then cooled down, filtered, and dried to obtain spherical core particles C100 having an average diameter of 37.3 μm.

| Preparation of carrier 100 | |
|---|---|
| Core particles C100 | 100 parts |
| Solution 3 for forming coating layer | |
| Toluene | 120 parts |
| Styrene-methyl metacrylate (St-MMA) copolymer (mass ratio of former monomer to latter monomer of 60:40, and weight-average molecular weight of 80,000) | 3.5 parts |
| Carbon black (Regal 330 manufactured by Cabot Corporation) | 0.4 parts |

The components except the core particles C100 are stirred with a stirrer for sixty minutes to prepare a solution 3 for forming a coating layer. Thereafter, the solution 3 and the ferrite particles are put in a fluidized bed (MP-01SFP manufactured by POWREX CORPORATION), and the fluidized bed is driven at a rotor revolution rate of 1,000 rpm at a gas volume of 1.2 $m^3$/min at a solution protruding speed of 10 g/min at 70° C. Thus, a coating is formed on each of the core particles. The resultant coated particles are sieved with a mesh having a pore size of 75 μm, and thus carrier 100 is manufactured.

The degree of circularity of the carrier 100 is 0.988, and the covering rate of the coating resin is 99%.

Preparation of Developer 100M

A developer is manufactured and evaluation using this developer is conducted in the same manner as in Example 1, except that the carrier 1 is replaced with the carrier 100. The evaluation results are shown in Table 6.

Example 101

A developer is manufactured and evaluation using this developer is conducted in the same manner as in Example 100, except that the amount of St-MMA in the solution 3 for forming a coating layer is varied to 3.1 parts. The evaluation results are shown in Table 6.

Example 102

A developer is manufactured and evaluation using this developer is conducted in the same manner as in Example 100, except that the time of the reaction and curing is changed to three hours in manufacturing the carrier core particles. The evaluation results are shown in Table 6.

Examples 103 to 107

A developer is manufactured and evaluation using this developer is conducted in the same manner as in Example 100, except that the Young's modulus of the substrate of the intermediate transfer member, the primary transfer nip pressure, the processing speed, and the primary transfer current value are respectively changed to the respective values shown in Table 4. The evaluation results are shown in Table 6.

Example 108

A developer is manufactured and evaluation using this developer is conducted in the same manner as in Example 100, except that the coating resin is changed from the styrene-methyl methacrylate copolymer to the silicone resin described in Example 14. The evaluation results are shown in Table 6.

Examples 109 to 115

Developers are manufactured and evaluation using each of these developers is conducted in the same manner as in Example 108, except that the covering rate of the coating resin, the degree of circularity, the Young's modulus of the substrate of the intermediate transfer member, the primary transfer nip pressure, the processing speed, and the primary transfer current value are respectively changed to the respective values shown in Table 4. These conditions in Examples 109 to 115 are respectively the same as those in Examples 101 to 107, except for the type of the coating resin. The evaluation results are shown in Table 6.

Example 116

A developer is manufactured and evaluation using this developer is conducted in the same manner as in Example 100, except that the amount of magnetite is changed to 450 parts in preparing the carrier core particles. The evaluation results are shown in Table 6.

Examples 117 to 118

Carrier core particles having different average diameters are manufactured in the same manner as in Example 100, except that the heating temperature and the curing time are respectively changed to 83° C. and five hours (Example 117), or 88° C. and four hours (Example 118).

Developers are manufactured and evaluation using each of these developers is conducted in the same manner as in Example 100, except that the carrier core particles 100 are replaced with the above carrier particles. The evaluation results are shown in Table 6.

Examples 119 to 120

Developers are manufactured and evaluation using each of these developers is conducted in the same manner as in Example 100, except that the styrene-methylmetacrylate copolymer is changed to polymethyl metacrylate (weight-average molecular weight of 80,000) or melamine resin (YUBAN 20SE60 manufactured by Mitsui Chemicals, Inc.) in preparing the carrier.

Comparative Example 101

| Comparative Example 101<br>Preparation of carrier 101 | |
|---|---|
| Core particles C100 | 100 parts |
| Solution 4 for forming coating layer | |
| Toluene | 40 parts |
| Styrene-methyl metacrylate copolymer (mass ratio of former monomer to latter monomer of 60:40, and weight-average molecular weight of 80,000) | 3.5 parts |
| Carbon black (Regal 330 manufactured by Cabot Corporation) | 0.4 parts |

The components except the core particles C100 are stirred with a stirrer for sixty minutes to prepare a solution 4 for forming a coating layer. Thereafter, the solution 4 and the core particles 100 are put in a vacuum degassing kneader (KHO-5 manufactured by INOUE MANUFACTURING CO., LTD.), and then stirred at 60° C. for 20 minutes. The pressure of the mixture, which is being heated, is reduced to remove gas and dry the mixture. The resultant coated particles are sieved with a mesh having a pore size of 75 μm, and thus carrier 101 is manufactured.

The degree of circularity of the carrier 101 is 0.985, and the coating content of the coating resin is 92%.

Preparation of Developer 4

A developer is manufactured and evaluation using this developer is conducted in the same manner as in Example 100, except that the carrier core particles 100 are replaced with the carrier core particles 101. The evaluation results are shown in Table 6.

Comparative Examples 102 to 109

Developers are manufactured and evaluation using each of these developers is conducted in the same manner as in Example 100, except that the type of the coating resin in the resin coating layer, the covering rate of the coating resin, the degree of circularity, the Young's modulus of the substrate of the intermediate transfer member, the primary transfer nip pressure, the processing speed, and the primary transfer current value are respectively changed to the respective values shown in Table 5. The evaluation results are shown in Table 6.

TABLE 4

| | Carrier | | | | | | Intermediate transfer member | Primary transfer | | | |
|---|---|---|---|---|---|---|---|---|---|---|---|
| | Core | | | Resin coating layer | | | Substrate | | Current | | |
| Ex. | Resin | Magnetic substance rate (mass %) | Particle diameter (μm) | Material | Covering rate (%) | Degree of circularity | Young's modulus (MPa) | Nip pressure (gf/cm) | value (T) (μA) | Processing speed (P) (mm/sec) | (T)/(P) |
| 100 | Phenol resin | 86 | 37.3 | St-MMA | 99 | 0.988 | 6000 | 11 | 20 | 165 | 0.12 |
| 101 | Phenol resin | 86 | 37.3 | St-MMA | 96 | 0.988 | 6000 | 11 | 20 | 165 | 0.12 |
| 102 | Phenol resin | 86 | 36.8 | St-MMA | 99 | 0.972 | 6000 | 11 | 20 | 165 | 0.12 |
| 103 | Phenol resin | 86 | 37.3 | St-MMA | 99 | 0.988 | 3500 | 11 | 20 | 165 | 0.12 |
| 104 | Phenol resin | 86 | 37.3 | St-MMA | 99 | 0.988 | 6000 | 8 | 20 | 165 | 0.12 |
| 105 | Phenol resin | 86 | 37.3 | St-MMA | 99 | 0.988 | 6000 | 20 | 20 | 165 | 0.12 |
| 106 | Phenol resin | 86 | 37.3 | St-MMA | 99 | 0.988 | 6000 | 11 | 18 | 220 | 0.08 |
| 107 | Phenol resin | 86 | 37.3 | St-MMA | 99 | 0.988 | 6000 | 11 | 19 | 104 | 0.18 |
| 108 | Phenol resin | 86 | 37.3 | Silicone | 98 | 0.988 | 6000 | 11 | 20 | 165 | 0.12 |
| 109 | Phenol resin | 86 | 37.3 | Silicone | 96 | 0.988 | 6000 | 11 | 20 | 165 | 0.12 |
| 110 | Phenol resin | 86 | 37.3 | Silicone | 99 | 0.972 | 6000 | 11 | 20 | 165 | 0.12 |
| 111 | Phenol resin | 86 | 37.3 | Silicone | 98 | 0.988 | 3500 | 11 | 20 | 165 | 0.12 |
| 112 | Phenol resin | 86 | 37.3 | Silicone | 99 | 0.988 | 6000 | 8 | 20 | 165 | 0.12 |
| 113 | Phenol resin | 86 | 37.3 | Silicone | 99 | 0.988 | 6000 | 20 | 20 | 165 | 0.12 |
| 114 | Phenol resin | 86 | 37.3 | Silicone | 99 | 0.988 | 6000 | 11 | 18 | 220 | 0.08 |
| 115 | Phenol resin | 86 | 37.3 | Silicone | 99 | 0.988 | 6000 | 11 | 19 | 104 | 0.18 |
| 116 | Phenol resin | 89 | 37.3 | St-MMA | 99 | 0.988 | 6000 | 11 | 20 | 165 | 0.12 |
| 117 | Phenol resin | 86 | 47.9 | St-MMA | 99 | 0.988 | 6000 | 11 | 20 | 165 | 0.12 |
| 118 | Phenol resin | 86 | 30.2 | St-MMA | 99 | 0.988 | 6000 | 11 | 20 | 165 | 0.12 |
| 119 | Phenol resin | 86 | 37.3 | PMMA | 99 | 0.988 | 6000 | 11 | 20 | 165 | 0.12 |
| 120 | Phenol resin | 86 | 37.3 | Melamine | 98 | 0.988 | 6000 | 11 | 20 | 165 | 0.12 |

TABLE 5

| | Carrier | | | | | | Intermediate transfer member | Primary transfer | | | |
|---|---|---|---|---|---|---|---|---|---|---|---|
| | Core | | | | | | | | | | |
| | Resin | Magnetic substance rate (mass %) | Particle diameter (μm) | Resin coating layer Material | Resin coating layer Covering rate (%) | Resin coating layer Degree of circularity | Substrate Young's modulus (Kg/cm$^2$) | Nip pressure (gf/cm) | Current value (T) (μA) | Processing speed (P) (mm/sec) | (T)/(P) |
| Comp. Ex. 101 | Phenol resin | 86 | 37.3 | St-MMA | 92 | 0.985 | 6000 | 11 | 20 | 165 | 0.12 |
| Comp. Ex. 102 | Phenol resin | 86 | 37.3 | St-MMA | 99 | 0.968 | 6000 | 11 | 20 | 165 | 0.12 |
| Comp. Ex. 103 | Phenol resin | 86 | 37.3 | St-MMA | 99 | 0.988 | 2500 | 11 | 20 | 165 | 0.12 |
| Comp. Ex. 104 | Phenol resin | 86 | 37.3 | St-MMA | 99 | 0.988 | 6000 | 7 | 20 | 165 | 0.12 |
| Comp. Ex. 105 | Phenol resin | 86 | 37.3 | St-MMA | 99 | 0.988 | 6000 | 21 | 20 | 165 | 0.12 |
| Comp. Ex. 106 | Phenol resin | 86 | 37.3 | St-MMA | 99 | 0.988 | 6000 | 11 | 15 | 220 | 0.07 |
| Comp. Ex. 107 | Phenol resin | 86 | 37.3 | St-MMA | 99 | 0.988 | 6000 | 11 | 20 | 104 | 0.19 |
| Comp. Ex. 108 | Phenol resin | 86 | 46.3 | St-MMA | 94 | 0.970 | 6000 | 11 | 20 | 165 | 0.12 |
| Comp. Ex. 109 | Phenol resin | 86 | 37.3 | Silicone | 94 | 0.970 | 6000 | 11 | 20 | 165 | 0.12 |

TABLE 6

| | Evaluation results | | |
|---|---|---|---|
| | Number of carrier pieces sticking into photoreceptor | Transfer misalignment (μm) | Image density |
| Example 100 | 1 | 40 | 1.54 |
| Example 101 | 6 | 50 | 1.51 |
| Example 102 | 5 | 40 | 1.51 |
| Example 103 | 0 | 80 | 1.52 |
| Example 104 | 0 | 60 | 1.54 |
| Example 105 | 7 | 40 | 1.55 |
| Example 106 | 0 | 50 | 1.43 |
| Example 107 | 5 | 40 | 1.49 |
| Example 108 | 1 | 40 | 1.51 |
| Example 109 | 4 | 40 | 1.54 |
| Example 110 | 6 | 30 | 1.51 |
| Example 111 | 0 | 90 | 1.53 |
| Example 112 | 0 | 60 | 1.53 |
| Example 113 | 4 | 30 | 1.42 |
| Example 114 | 0 | 40 | 1.51 |
| Example 115 | 6 | 40 | 1.49 |
| Example 116 | 1 | 50 | 1.52 |
| Example 117 | 3 | 40 | 1.52 |
| Example 118 | 2 | 50 | 1.54 |
| Example 119 | 3 | 30 | 1.53 |
| Example 120 | 1 | 30 | 1.51 |
| Comparative Example 101 | 15 | 40 | 1.51 |
| Comparative Example 102 | 16 | 50 | 1.50 |
| Comparative Example 103 | 0 | 160 | 1.49 |
| Comparative Example 104 | 0 | 30 | 1.35 |
| Comparative Example 105 | 20 | 40 | 1.51 |
| Comparative Example 106 | 0 | 40 | 1.31 |
| Comparative Example 107 | 26 | 40 | 1.49 |
| Comparative | 32 | 100 | 1.54 |

TABLE 6-continued

| | Evaluation results | | |
|---|---|---|---|
| | Number of carrier pieces sticking into photoreceptor | Transfer misalignment (μm) | Image density |
| Example 108 Comparative Example 109 | 21 | 30 | 1.52 |

What is claimed is:

1. A method of forming a composite color image, comprising:

electrically charging a latent image-holding member;

exposing the charged latent image-holding member to light to form an electrostatic latent image;

developing the electrostatic latent image with a two-component developer containing toner particles of one color and a carrier to form a toner image on the latent image-holding member;

primarily transferring the toner image from the latent image-holding member to an intermediate transfer member;

repeating the electrically charging, the exposing, the developing, and the primarily transferring, while the toner particles are replaced with toner particles of different color, to form a composite color image on the intermediate transfer member; and secondarily transferring the composite color image from the intermediate transfer member to a recording medium, wherein the carrier comprises:

magnetic substance core particles that are inorganic particles having surface roughness, or mean spacing between protrusions, Sm of from 0.5 μm to 2.0 μm and surface roughness, or arithmetic average roughness, Ra of from 0.1 μm to 0.8 μm and a coating layer that is made of a resin and that coats the surface of each of the magnetic substance core particles that are inorganic particles at a coating content of from 3 to 10 percent by mass relative to the total mass of the magnetic substance core particles that are inorganic particles, the carrier has a degree of circularity of 0.970 or more, the intermediate transfer member is a belt that has a substrate whose Young's modulus is in the range of from 3,000 to 6,500 MPa, during the primary transferring, primary transfer nip pressure is in the range of from 8 to 20 gf/cm, and a value (T/P) obtained by dividing a primary transfer current value T by a processing speed P is in the range of from 0.08 to 0.18 μA.sec/mm, and the processing speed P is 165 mm/sec or more.

2. The method of forming a composite color image of claim 1, wherein the surface roughness, or the mean spacing between protrusions, Sm of the magnetic substance core particles that are inorganic particles is from 0.5 μm to 1.8 μm.

3. The method of forming a composite color image of claim 1, wherein the surface roughness, or the mean spacing between protrusions, Sm of the magnetic substance core particles that are inorganic particles is from 0.5 μm to 1.6 μm.

4. The method of forming a composite color image of claim 1, wherein the primary transfer nip pressure is in the range of from 9 to 18 gf/cm.

5. The method of forming a composite color image of claim 1, wherein the primary transfer nip pressure is in the range of from 9 to 16 gf/cm.

6. The method of forming a composite color image of claim 1, wherein the processing speed P is in the range of from 165 to 350 mm/sec.

7. The method of forming a composite color image of claim 1, wherein the processing speed P is in the range of from 165 to 320 mm/sec.

8. The method of forming a composite color image of claim 1, wherein the processing speed P is 220 mm/sec or less.

9. The method of forming a composite color image of claim 1, wherein the carrier has a volume electric resistance of from $1\times10^{8}$ to $1\times10^{15}$ Ω.cm.

10. The method of forming a composite color image of claim 1, wherein the Ra of the magnetic substance core particles that are inorganic particles is from 0.2 μm to 0.8 μm.

11. The method of forming a composite color image of claim 1, wherein the Ra of the magnetic substance core particles that are inorganic particles is from 0.3 μm to 0.8 μm.

12. The method of forming a composite color image of claim 1, wherein the magnetic substance core particles that are inorganic particles are Mn—Mg ferrite particles.

* * * * *